US008673525B2

(12) United States Patent
Yagi

(10) Patent No.: US 8,673,525 B2
(45) Date of Patent: Mar. 18, 2014

(54) ELECTROPHOTOGRAPHIC PHOTORECEPTOR, PROCESS CARTRIDGE AND IMAGE FORMING APPARATUS

(75) Inventor: Shigeru Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 512 days.

(21) Appl. No.: 12/637,429

(22) Filed: Dec. 14, 2009

(65) Prior Publication Data

US 2010/0330481 A1 Dec. 30, 2010

(30) Foreign Application Priority Data

Jun. 26, 2009 (JP) ..... 2009-152865

(51) Int. Cl.
*G03G 5/147* (2006.01)
*G03G 15/16* (2006.01)

(52) U.S. Cl.
USPC ..... 430/66; 399/111; 399/115

(58) Field of Classification Search
USPC ..... 430/66; 399/111, 115
See application file for complete search history.

(56) References Cited

U.S. PATENT DOCUMENTS

| | | | |
|---|---|---|---|
| 2008/0070138 | A1 | 3/2008 | Yagi et al. |
| 2008/0254379 | A1 | 10/2008 | Iwanaga et al. |
| 2010/0330481 | A1 | 12/2010 | Yagi |

FOREIGN PATENT DOCUMENTS

| | | |
|---|---|---|
| JP | A-2-110470 | 4/1990 |
| JP | A-11-186571 | 7/1999 |
| JP | A-2003-27238 | 1/2003 |
| JP | A-2003-29437 | 1/2003 |
| JP | A-2003-316053 | 11/2003 |
| JP | A-2006-267507 | 10/2006 |
| JP | A-2008-76520 | 4/2008 |
| JP | A-2008-268266 | 11/2008 |

OTHER PUBLICATIONS

Oct. 16, 2012 Office Action issued in U.S. Appl. No. 12/767,321.

*Primary Examiner* — Jonathan Jelsma
(74) *Attorney, Agent, or Firm* — Oliff PLC

(57) ABSTRACT

There is provided an electrophotographic photoreceptor comprising, in this order a substrate; a photosensitive layer; and a protective layer including oxygen and gallium, the protective layer including a first region and a second region that is present closer to the substrate than the first region and has a ratio of the number of atoms of oxygen to the number of atoms of gallium (oxygen/gallium) larger than that in the first region.

20 Claims, 6 Drawing Sheets

ELECTROPHOTOGRAPHIC PHOTORECEPTOR, PROCESS CARTRIDGE AND IMAGE FORMING APPARATUS

CROSS-REFERENCE TO RELATED APPLICATIONS

This application is based on and claims priority under 35 USC 119 from Japanese Patent Application No. 2009-152865 filed on Jun. 26, 2009.

BACKGROUND

1. Technical Field

The present invention relates to an electrophotographic photoreceptor, a process cartridge and an image forming apparatus.

2. Related Art

Xerography is utilized widely in copiers, printers etc.

With respect to an electrophotographic photoreceptor (referred to sometimes as a "photoreceptor") used in an image forming apparatus utilizing xerography, techniques of providing the surface of a photosensitive layer of the photoreceptor with a surface layer (protective layer) have been investigated in recent years.

SUMMARY

According to an aspect of the present invention, there is provided an electrophotographic photoreceptor including, in this order: a substrate; a photosensitive layer; and a protective layer including oxygen and gallium, the protective layer including a first region and a second region that is present closer to the substrate than the first region and has a ratio of the number of atoms of oxygen to the number of atoms of gallium (oxygen/gallium) larger than that in the first region.

BRIEF DESCRIPTION OF THE DRAWINGS

Exemplary embodiments of the present invention will be described in detail based on the following figures, wherein.

DETAILED DESCRIPTION

Figure 1:
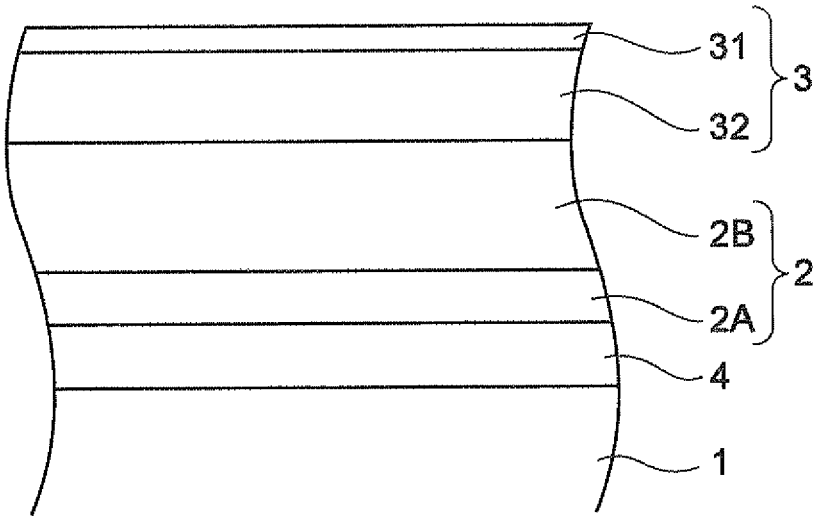
FIG. 1 is a schematic sectional view showing one example of a layer structure of the electrophotographic photoreceptor in the exemplary embodiment.

Hereinafter, exemplary embodiments of the electrophotographic photoreceptor, the process cartridge and the image forming apparatus of the invention will be described in detail.

<Electrophotographic Photoreceptor>

The electrophotographic photoreceptor in the exemplary embodiment includes, in this order, a substrate, a photosensitive layer, and a protective layer including oxygen and gallium, the protective layer including a first region and a second region that is present closer to the substrate than the first region and has a ratio of the number of atoms of oxygen to the number of atoms of gallium (oxygen/gallium) (hereinafter, may also be referred to as a "ratio of the number of atoms O/Ga" or a "ratio of the number of atoms oxygen/gallium") larger than that in the first region.

That is, the protective layer is configured to have, in the distribution of a ratio of the number of atoms of oxygen to the number of atoms of gallium (oxygen/gallium) in the direction of layer thickness, a first region that may be present at or near the outer circumference surface side and a second region that is present closer to the substrate than the first region and has a ratio of the number of atoms of oxygen to the number of atoms of gallium (oxygen/gallium) larger than that in the first region.

The protective layer may, if necessary, include a region other than the first region and the second region.

Generally, when a protective layer including oxygen and gallium is formed on the surface of a photosensitive layer of an electrophotographic photoreceptor, the sensitivity of the electrophotographic photoreceptor tends to decrease due to the presence of the protective layer. Particularly, when the ratio of the number of atoms oxygen/gallium is decreased and the resistance of the layer is lowered to decrease the residual potential, then the layer tends to be colored due to light absorption in the whole visible range and the sensitivity reduction tends to increase.

However, as a result of the present inventors' investigation, it was revealed that when a region (first region) in which the ratio of the number of atoms oxygen/gallium is relatively low is arranged so as to be more apart from the substrate than a region (second region) containing oxygen and gallium, then the deterioration in sensitivity due to the presence of the protective layer can be reduced. The reason for this is thought as follows. That is, it may be thought that the first region has a function of injecting charges, while the second region has a function of transporting charges, and as a result, the residual potential may be reduced and simultaneously the light absorption may be reduced. However, the exemplary embodiment is not limited by this reason.

Accordingly, in the electrophotographic photoreceptor which has a structure of the exemplary embodiment described above, the deterioration in sensitivity due to the presence of the protective layer may be suppressed, compared with the electrophotographic photoreceptor which does not include a second region having a ratio of the number of atoms oxygen/gallium larger than that in the first region that may be present at or near the outer circumference surface side.

Further, residual potential may be reduced when the electrophotographic photoreceptor has the structure of the exemplary embodiment described above.

In the exemplary embodiment, the first region and the second region each may have a clear boundary face to an adjacent region or the boundary face between the first region and an adjacent region and/or the boundary face between the second region and an adjacent region may be unclear.

Hereinafter, the first region having a clear boundary face to the adjacent region is referred to as "first layer" and the second region having a clear boundary face to the adjacent region is referred to as "second layer".

That is, the protective layer may be configured to include a first layer that may be present at or near the outer circumference surface side and the second layer that is present closer to the substrate than the first layer and has a ratio of the number of atoms of oxygen to the number of atoms of gallium (oxygen/gallium) larger than that in the first layer.

When the protective layer includes the first layer and the second layer, an intermediate layer having a ratio of the number of atoms oxygen/gallium that is equal to or larger than a ratio of the number of atoms oxygen/gallium of the first layer and is equal to or smaller than a ratio of the number of atoms oxygen/gallium of the second layer may be disposed between the first layer and the second layer.

When the protective layer includes the intermediate layer, the increase in residual potential and the decrease in sensitivity by the presence of the protective layer may be further decreased. The reason for this may be thought that transportation of charges from the first layer to the second layer may be carried out effectively. However, the embodiment in which the protective layer includes the intermediate layer is not limited by this reason.

In the exemplary embodiment, the composition of a protective layer and a ratio of the number of atoms oxygen/gallium, also including distribution thereof in the direction of layer thickness, are determined by, for example, Rutherford Back Scattering (RBS).

In RBS, for example, 3SDH Pelletron (trade name, available from NEC Corporation) is used as an accelerator, RBS-400 (trade name, available from CE&A) is used as an end station, and 3S—R10 is used as a system. In the analysis, HYPRA program (available from CE&A), or the like, is used.

Measurement conditions for RBS are that as follows. That is, the $He^{++}$ ion beam energy is 2.275 eV, the detection angle is 160°, and the grazing angle to incident beam is 109°.

The RBS measurement is carried out as follows.

First, $He^{++}$ ion beam is allowed to be incident vertically on a sample, and a detector is set at 160° C. relative to the ion beam, and the backscattering He signal is measured. From the detected He energy and strength, the composition ratio and film thickness are determined. For improving accuracy for determining the composition ratio and a film thickness, spectrums may be measured at 2 detection angles. The measurements may be carried out with 2 detection angles different in depth detection dissolution and backscattering dynamics and cross-checking may be carried out, thereby improving accuracy.

The number of He atoms backscattered with target atoms is determined by 3 factors of 1) the atomic number of target atom, 2) the energy of He atom before scattering, and 3) scattering angle.

The density is presumed by calculation from the measured composition, and the layer thickness is thereby calculated. The error in density is within 20%.

Even when the second region and the first region are continuously formed on the photosensitive layer, by using the above described method, the elemental composition in each of the first and second regions can be measured while destruction of the surface layer portion (first region) may be suppressed.

The content of each element in the whole protective layer is measured, for example, by secondary electron mass spectrometry or XPS (X-ray photoelectron spectroscopy).

The protective layer in the exemplary embodiment may, if necessary, include another region (or regions) other than the first and second regions.

For example, the protective layer may include a third region that is present closer to the substrate than the second region and has a ratio of the number of atoms of oxygen to the number of atoms of gallium (oxygen/gallium) smaller than that in the second region.

When the protective layer includes the third region, the distribution of the ratio of the number of atoms oxygen/gallium in the direction of layer thickness of the protective layer is such that the ratio of the number of atoms oxygen/gallium once increases (second region) from the first region that may be present at or near the outer circumference surface side, then decreases again (third region that is present closer to the photosensitive layer than the second layer).

When the protective layer includes the third region, the residual potential during repetitive use may be suppressed. That is, the repetitive characteristics of the electrophotographic photoreceptor may be improved. The reason for this may be thought that holes generated in the photosensitive layer by repetitive use are injected into the third region. However, the embodiment in which the protective layer includes the third region is not limited by this reason.

The third region may be a third layer that has clear boundary faces from other regions.

Generally, when the layer thickness of the protective layer increases, the durability thereof as the electrophotographic photoreceptor tends to be improved, whereas the decrease in sensitivity due to the presence of the protective layer tends to increase.

The protective layer in the exemplary embodiment, as described above, has an effect of suppressing decrease in sensitivity due to the presence of the protective layer, and is thus suitable for the form of the protective layer having increased layer thickness. That is, even if the layer thickness is increased, the deterioration in sensitivity due to the presence of the protective layer can be suppressed according to the exemplary embodiment.

Accordingly, the layer thickness of the protective layer is preferably 1.0 μm (or about 1.0 μm) or more, from the viewpoint of satisfying both improvement of durability and suppression of decrease in sensitivity due to the presence of the protective layer. The layer thickness is more preferably 1.5 μm or more, even more preferably 2.0 μm or more, and still more preferably 2.5 μm or more.

The upper limit of layer thickness of the protective layer is not particularly limited, but from the viewpoint of suppressing the reduction in sensitivity due to the presence of the protective layer and of suppressing increase in residual potential, the upper limit of layer thickness may be 6.0 μm.

Examples of the method of confirming the durability of the electrophotographic photoreceptor includes a method of examining scratches on the surface of the electrophotographic photoreceptor which have been repeatedly used for image formation (as scratches decrease, durability increases).

Alternatively, when image formation is repeatedly performed, in the formed image, white line-shaped image defects attributable to scratches on the surface of the electrophotographic photoreceptor may be examined (as the white line-shaped image defects decrease, durability increases).

In the second region in the protective layer, the ratio of the number of atoms (oxygen/gallium) may be from 1.30 (or about 1.30) to 1.50 (or about 1.50).

When the ratio of the number of atoms oxygen/gallium is in this range, coloring of the second region may be suppressed (that is, transparency may be improved), and the light transmittance of the range from ultraviolet to infrared wavelengths (for example, the wavelength region of from 350 to 800 nm) may be improved. Accordingly, the charges of the charged photoreceptor may be erased, whereby, when the photoreceptor is irradiated with light from the outside of the photoreceptor, the absorption of the light on the protective layer may be suppressed. Accordingly, the irradiated light may efficiently reach the photosensitive layer and, consequently, the sensitivity of the electrophotographic photoreceptor may be improved.

Further, even if the ratio of the number of atoms oxygen/gallium in the second region is from 1.30 to 1.50, the residual potential can be suppressed as described above since the first region is present more apart from the substrate than the second region.

The second region in the protective layer may further contain zinc (Zn).

When the second region contains zinc, decrease in sensitivity may be further suppressed, and residual potential may be further suppressed.

The reason for this may be thought that zinc is contained in the second region, whereby the charge transferability of the second region is improved. However, the embodiment in which the protective layer contains zinc is not limited by this reason.

From the viewpoint of preventing residual potential, the content of zinc in the second region is preferably from 0.4% by atom (or about 0.4% by atom) to 25% by atom (or about 25% by atom), more preferably from 0.5% by atom (or about 0.5% by atom) to 20% by atom (or about 20% by atom), and still more preferably from 10% by atom (or about 10% by atom) to 20% by atom (or about 20% by atom).

When the second region includes gallium, oxygen and zinc, the content of zinc in the second region is the ratio (%) of the number of atoms of zinc relative to the sum of the number of atoms of these three kinds of atoms (i.e., gallium, oxygen and zinc).

From the viewpoint of suppressing the decrease in sensitivity, the ratio of the number of atoms of oxygen to the sum of the number of atoms of gallium and zinc (oxygen/(gallium+zinc)) in the second region is preferably from 1.00 (or about 1.00) to 1.40 (or about 1.40).

From the viewpoint of suppressing the decrease in sensitivity, the ratio of the number of atoms of zinc to the number of atoms of gallium (zinc/gallium) in the second region is preferably 1.00 or less, more preferably from 0.01 to 0.50, and still more preferably 0.20 to 0.50.

From the viewpoint of suppressing the decrease in sensitivity, the content of zinc in the second region is preferably from 0.4% by atom (or about 0.4% by atom) to 25% by atom (or about 25% by atom), more preferably from 0.5% by atom (or about 0.5% by atom) to 20% by atom (or about 20% by atom), and even more preferably from 1% by atom (or about 1% by atom) to 15% by atom % (or about 15% by atom).

Structure of Electrophotographic Photoreceptor

Hereinafter, the structure of the electrophotographic photoreceptor in the exemplary embodiment will be described with reference to FIGS. 1 to 4, but the exemplary embodiment is not limited to FIGS. 1 to 4.

FIG. 1 is a schematic sectional view showing one example of the layer structure of the electrophotographic photoreceptor in the exemplary embodiment.

In FIG. 1, 1 is a substrate, 2 is a photoreceptor, 2A is a charge generation layer, 2B is a charge transport layer, 3 is a protective layer, 31 is a first region, and 32 is a second region. 4 is an undercoat layer.

The photoreceptor shown in FIG. 1 has a layer structure in which the undercoat layer 4, the charge generation layer 2A, the charge transport layer 2B and the protective layer 3 are disposed on the substrate 1 in this order, and the photosensitive layer 2 includes two layers, i.e. a charge generation layer 2A and a charge transport layer 2B.

The protective layer 3 includes a first region 31 that is present at the outer circumference surface side and a second region 32 that is present closer to the substrate 1 than the first region 31.

In FIG. 1, for the sake of illustration, the border between the first region 31 and the second region 32 is clear (that is, the first region 31 is the first layer and the second region 32 is the second layer), but the border is not limited by its clearness and may be unclear. In the following, the same also applied to the border between the first region 31 and the second region 32 in FIGS. 2 and 3 and the border between the second region 32 and the third region 33 in FIG. 3.

Figure 2:
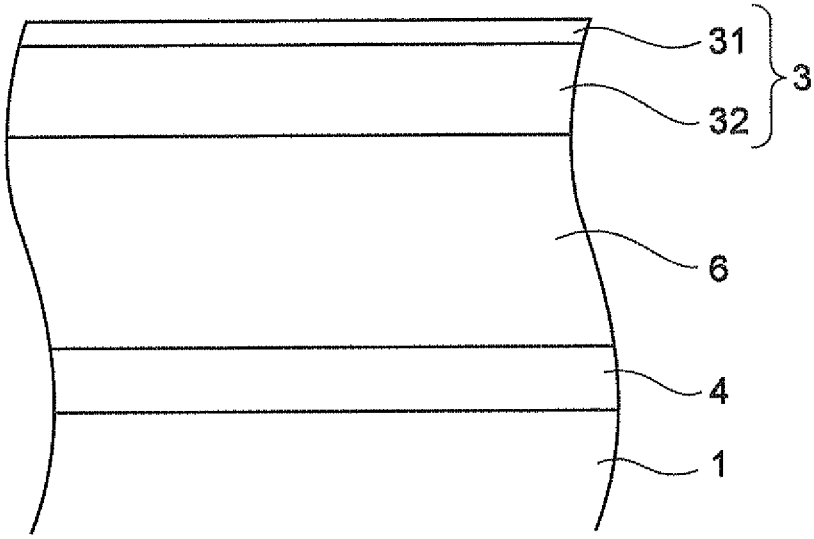
FIG. 2 is a schematic sectional view showing another example of a layer structure of the electrophotographic photoreceptor in the exemplary embodiment.

FIG. 2 is a schematic sectional view showing another example of the electrophotographic photoreceptor in the exemplary embodiment, and in FIG. 2, 6 represents a photosensitive layer, and others are the same as shown in FIG. 1.

The photoreceptor shown in FIG. 2 has a layer structure wherein an undercoat layer 4, a photosensitive layer 6 and a protective layer 3 are disposed in this order on a substrate 1, and the photosensitive layer 6 is a layer in which the functions of the charge generation layer 2A and the charge transport layer 2B shown in FIG. 1 are integrated.

The photosensitive layer 2 and photosensitive layer 6 each may be formed of an organic polymer, an inorganic material, or a combination thereof.

Figure 3:
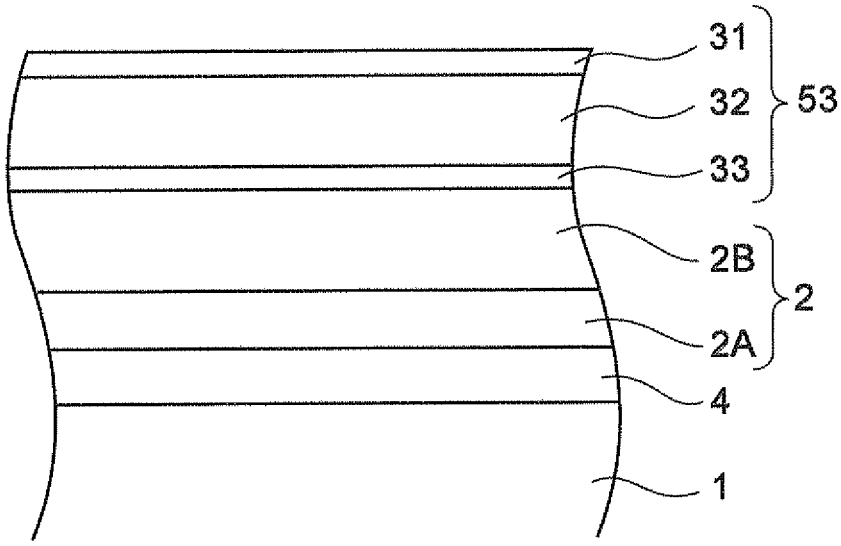
FIG. 3 is a schematic sectional view showing another example of a layer structure of the electrophotographic photoreceptor in the exemplary embodiment.

FIG. 3 is a schematic sectional view of a layer structure of the electrophotographic photoreceptor in the exemplary embodiment, and in FIG. 3, 53 is a protective layer, 31 is a first region, 32 is a second region, and 33 is a third region, and others are the same as shown in FIG. 1.

The photoreceptor shown in FIG. 3 has a layer structure wherein an undercoat layer 4, a photosensitive layer 2, a third region 33, a second region 32, and a first region 31 are laminated in this order on a substrate 1.

The protective layer 53 includes a first region 31 that is present at the outer circumference surface side, a second region 32 that is present closer to the substrate 1 than the first region 31, and a third region 33 that is present closer to the substrate 1 than the second region.

Figure 4:
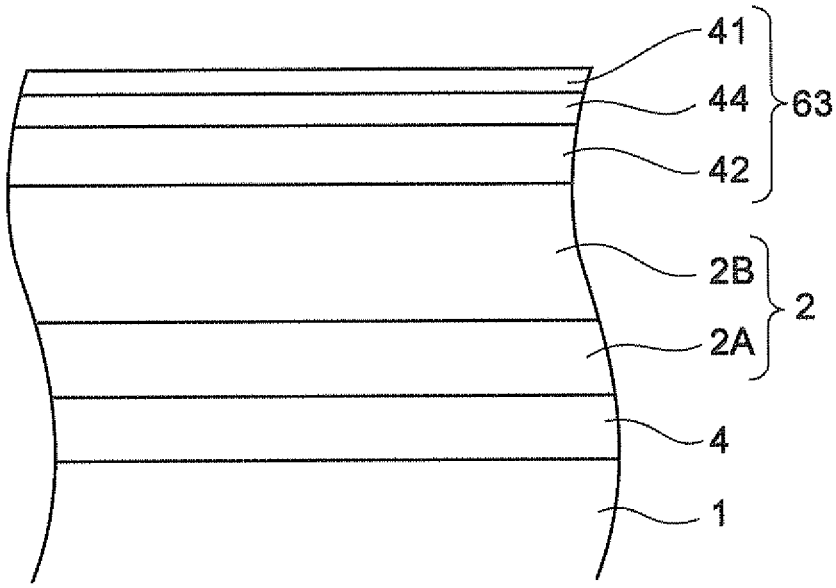
FIG. 4 is a schematic sectional view showing another example of a layer structure of the electrophotographic photoreceptor in the exemplary embodiment.

FIG. 4 is a schematic sectional view of a layer structure of the electrophotographic photoreceptor in the exemplary embodiment, and in FIG. 4, 63 is a protective layer, 41 is a first layer, 42 is a second layer, 44 is an intermediate layer, and others are the same as shown in FIG. 1.

The photoreceptor shown in FIG. 4 has a layer structure wherein an undercoat layer 4, a photosensitive layer 2, a second layer 42, an intermediate layer 44, and a first layer 41 are disposed in this order on a substrate 1.

The protective layer 63 includes a first layer 41 that is present at the outer circumference surface side, a second layer 42 that is present closer to the substrate 1 than the first layer 41, and an intermediate layer 44 that is present between the first layer 41 and the second layer 42.

The photoreceptor shown in FIG. 4 may include the third region between the photosensitive layer 2 and the second layer 42.

Hereinafter, the constituent components of the electrophotographic photoreceptor in the exemplary embodiment, that is, the protective layer, the photosensitive layer and the substrate, will be described.

Protective Layer

The protective layer in the exemplary embodiment includes oxygen (O) and gallium (Ga) as described above and is disposed on a photosensitive layer that is disposed on the substrate.

The protective layer is disposed, for example for the purpose of suppressing scratching on the surface of the electrophotographic photoreceptor, suppressing irregular polishing, suppressing adsorption of nitrogen oxide and the like, and improving resistance to an oxidative atmosphere with ozone and nitrogen oxides. The protective layer is preferably a highly transparent, dense and hard film.

The protective layer in the exemplary embodiment may have surface charges trapped thereon or may have charges trapped therein. The surface charges may be actively injected. When the charges are injected into the protective layer, the protective layer preferably has a structure wherein charges are trapped at the boundary face with the organic photosensitive layer. When the surface layer injects electrons with negative charges, the surface of the hole transport layer may function of trapping charges, or a layer for blocking injection of charges and for trapping charges may be provided. When positively charged, the protective layer may be configured in a similar manner.

The protective layer in the exemplary embodiment is preferably a non-single-crystal film such as a fine crystal film, polycrystalline film or amorphous film, containing oxygen (O) and gallium (Ga).

Among these films, the amorphous film is particularly preferable in respect of surface smoothness, and the fine crystal film is more preferable in respect of hardness.

The growth section of the protective layer may have a pillar structure and is preferably a structure having high smoothness from the viewpoint of slipping property and is preferably amorphous.

From the viewpoint of increasing adhesiveness to the photosensitive layer and for improving slipping property on the surface, the region closer to the boundary face with the photosensitive layer (for example, the second region) is formed into a fine crystal film, and the region closer to the surface (for example, the first region) is formed into an amorphous film.

The protective layer may further contain 1 or more elements selected from the group consisting of C, Si, Ge, and Sn, in the case of n type. In the case of p type, for example, one or more elements selected from the group consisting of N, Be, Mg, Ca and Sr may be contained.

The protective layer preferably contains at least one selected from the group consisting of hydrogen and halogen elements in addition to oxygen (O) and gallium (Ga).

When the protective layer is fine crystalline, polycrystalline or amorphous, binding defects, dislocation defects, and defects of crystal grain boundaries may tend to occur often, but when the at least one selected from the group consisting of hydrogen and halogen elements is contained in the layer, binding defects may be inactivated.

The at least one selected from the group consisting of hydrogen and halogen elements is incorporated into binding defects in crystals and into defects of crystal grain boundaries, thereby compensating electrically therefor. Accordingly, trapping involved in photogeneration of carriers and carrier diffusion may be reduced, reaction active sites may be decreased, and a more stable protective layer may be obtained.

The content of the "at least one selected from the group consisting of hydrogen and halogen elements" in the protective layer is preferably from 5 to 25% by atom, more preferably from 10 to 25% by atom.

The content of hydrogen in the protective layer may be obtained by, for example, measuring an absolute value by hydrogen forward scantling (HFS). Alternatively, the hydrogen content may be estimated with infrared absorption spectrum.

In HFS, for example, 3SDH Pelletron (trade name; available from NEC) is used as an accelerator, RBS-400 (trade name; available from CE&A) is used as an end station, and 3S—R10 (trade name; available from CE&A) is used as a system.

In the analysis, HYPRA program manufactured by CE&A is used.

Measurement conditions for HFS are as follows:

$He^{++}$ ion beam energy: 2.275 eV

Detection angle: 160°

Grazing angle with respect to incident beam: 30°

In HFS measurement, a detector is set at 30° relative to $He^{++}$ ion beam, and a sample is set at 75° relative to the normal line, thereby picking up hydrogen signals scattered forward from a sample. At this time, a detector is preferably covered with an aluminum foil, and He atoms scattered with hydrogen are preferably removed. The quantification is carried out by standardizing a hydrogen counter of a reference sample and a sample to be measured with stopping power and then comparing them. A sample having H ions introduced into Si, and white mica, are used as reference samples.

It is known that the hydrogen concentration of white mica is 6.5% by atom.

With respect to H adsorbed onto the outermost surface, correction may be made by, for example, subtracting the amount of H adsorbed on a clean surface of Si.

—First Region—

The first region in the exemplary embodiment is a region that may be present at or near the outer circumference surface side (the side apart from the support) in the protective layer.

The composition of the first region is not particularly limited and examples thereof include a composition containing gallium and oxygen.

When the first region contains gallium and oxygen, the ratio of the number of atoms O/Ga is preferably from 1.00 to less than 1.35, and more preferably from 1.10 to 1.30.

From the viewpoint of effectively reducing decrease in the sensitivity of the photoreceptor, the first region may contain hydrogen.

The content of hydrogen in the first region is preferably from 5 to 25% by atom, and more preferably from 10 to 25% by atom.

Preferable exemplary embodiments of the first region include those described above as the preferable embodiments of the protective layer.

The first region as described above may contain n- or p-type elements for regulation of conductivity type, but in this case, the first region may be a charge injection blocking layer or may be a charge injection layer. When the first region is a charge injection layer, charges are trapped in the second region or at the surface of the photosensitive layer.

In the case of negative charging, the n-type layer functions as a charge injection layer, and the p-type layer functions as a charge injection blocking layer. In the case of positive charging, the n-type layer functions as a charge injection blocking layer, and the p-type layer functions as a charge injection layer.

—Second Region—

The second region in the exemplary embodiment is a region that is present closer to the substrate than the first region and has a higher ratio of the number of atoms oxygen/gallium than that in the first region.

The composition of the second region is a composition containing gallium and oxygen (and zinc if necessary) as described above.

The second region may further contain hydrogen from the viewpoint of effectively reducing the decrease in sensitivity of the photoreceptor.

The content of hydrogen in the second region is preferably from 5 to 25% by atom, and more preferably from 10 to 25% by atom.

Preferable exemplary embodiments of the second region include those described above as preferable embodiments of the protective layer.

—Third Region—

The third region is a region that may be disposed in the protective layer if necessary. If the protective layer includes the third region, the third region is present closer to the substrate than the second region (preferably in contact with the photosensitive layer), and has a ratio of the number of atoms oxygen/gallium lower than that in the second region.

The composition in the third region is not particularly limited, and examples thereof include a composition containing gallium and oxygen.

When the third region contains gallium and oxygen, the ratio of the number of atoms O/Ga is preferably from 1.00 to less than 1,40, and more preferably from 1.10 to 1.35.

From the viewpoint of effectively reducing the decrease in sensitivity of the photoreceptor, the third region may contain hydrogen.

The content of hydrogen in the third region is preferably from 5 to 25% by atom, and more preferably from 10 to 25% by atom.

Preferable exemplary embodiments of the third region include those described above as the preferable exemplary embodiments of the protective layer.

—Intermediate Layer—

The intermediate layer is a layer that may be disposed in the protective layer as necessary, and when the protective layer includes a first layer and a second layer, the intermediate layer is disposed between the first layer and the second layer and provided with a composition having a ratio of the number of atoms oxygen/gallium that is equal to or larger than the ratio of the number of atoms oxygen/gallium in the first layer and is equal to or lower than the ratio of the number of atoms oxygen/gallium in the second layer.

The composition of the intermediate layer may be, for example, a composition containing gallium and oxygen (and zinc as necessary).

From the viewpoint of effectively reducing the decrease in sensitivity of the photoreceptor, the intermediate layer may contain hydrogen.

The content of hydrogen in the intermediate layer is preferably from 5 to 25% by atom, and more preferably from 10 to 25% by atom.

Preferable embodiments of the intermediate layer include those described above as the preferable exemplary embodiments of the protective layer.

The protective layer in the exemplary embodiment may include other layers or regions as necessary in addition to the first region, the second region, the third region and the intermediate layer.

Method of Forming the Protective Layer

Then, the method of forming the protective layer described above will be described.

In formation of the protective layer, known vapor phase deposition methods such as a plasma CVD (chemical vapor deposition) method, an organic metal vapor phase epitaxy method, a molecular beam epitaxy method, vapor deposition, and sputtering may be employed.

Figure 5A:
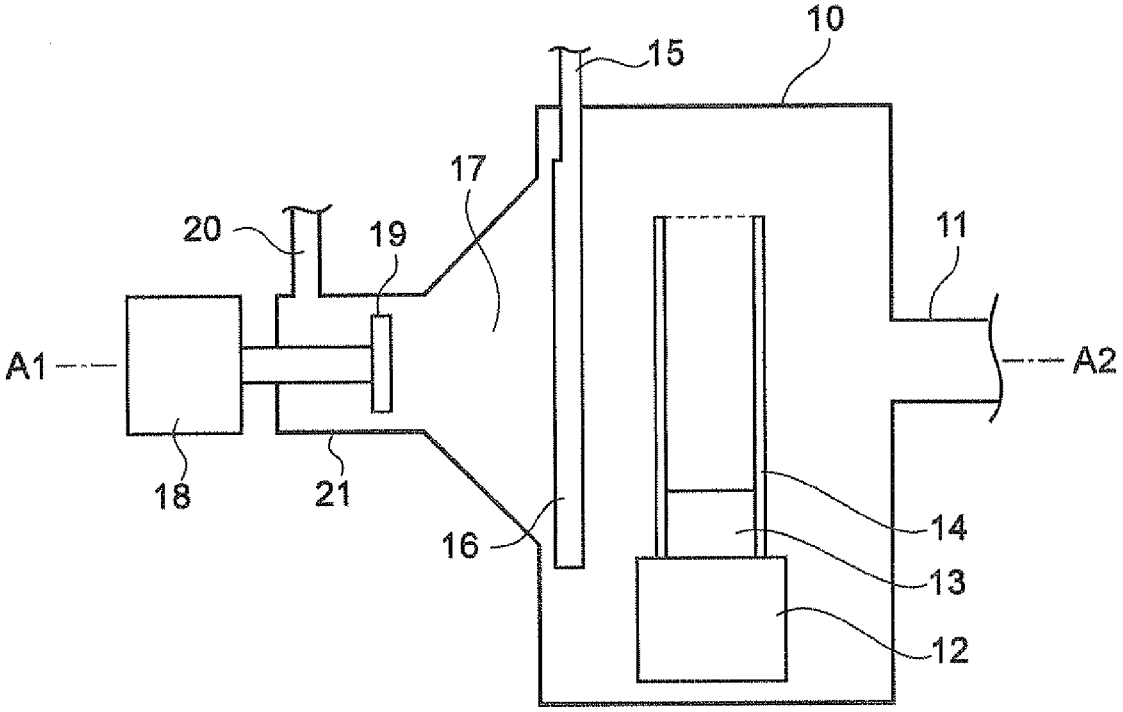
FIGS. 5A and 5B is a schematic diagram showing one example of a film-forming apparatus used in formation of a protective layer of the electrophotographic photoreceptor in the exemplary embodiment.
Figure 5B:
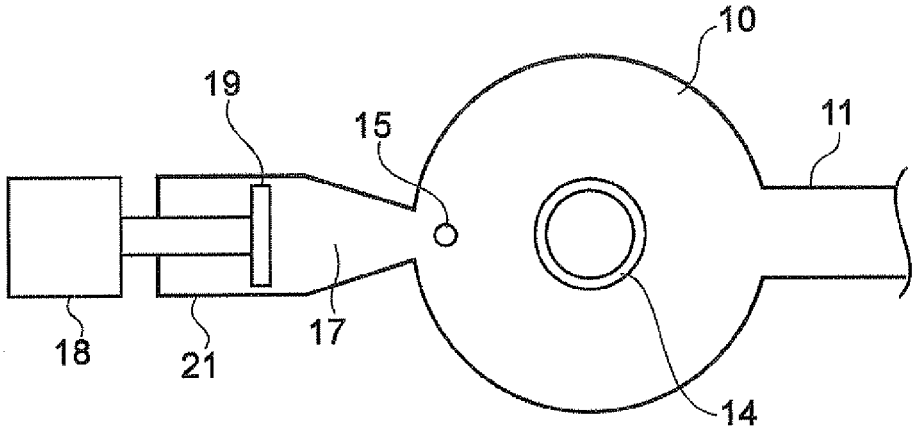

FIGS. 5A and 5B are schematic diagrams showing one example of a film-forming apparatus used in formation of a protective layer of the electrophotographic photoreceptor in the exemplary embodiment, wherein FIG. 5A is a schematic cross section of the film-forming apparatus viewed from the side, and FIG. 5B is a schematic cross section between A1-A2, of the film-forming apparatus in FIG. 5A. In FIGS. 5A and 5B, 10 is a deposition chamber, 11 is an exhaust opening, 12 is a substrate rotating part, 13 is a substrate supporting member, 14 is a base material, 15 is a gas introducing tube, 16 is a shower nozzle having an opening for jetting a gas introduced from the gas introduction tube 15, 17 is a plasma diffusing part, 18 is a high-frequency power supplying part, 19 is a plate electrode, 20 is a gas introduction tube, and 21 is a high-frequency discharge tube part.

In the film-forming apparatus shown in FIGS. 5A and B, one end of the deposition chamber 10 is provided with an exhaust opening 11 connected to a evacuation device (not shown), and at the opposite side of the exhaust opening 11 in the deposition chamber 10, a plasma generation device including the high-frequency power supplying part 18, the plate electrode 19 and the high-frequency discharge tube part 21 is disposed.

This plasma generation device includes the high-frequency discharge tube part 21, the plate electrode 19 disposed inside of the high-frequency discharge tube part 21 such that a discharge surface of the electrode 19 faces the side of the exhaust opening 11, and the high-frequency power supplying part 18 disposed outside of the high-frequency discharge tube part 21 and connected to the opposite side of the discharge surface of the plate electrode 19. The gas introduction tube 20 for supplying a gas to the high-frequency discharge tube part 21 is connected to the high-frequency discharge tube part 21, and one end of the gas introduction tube 20 is connected to a first gas supplying source not shown.

Figure 6:
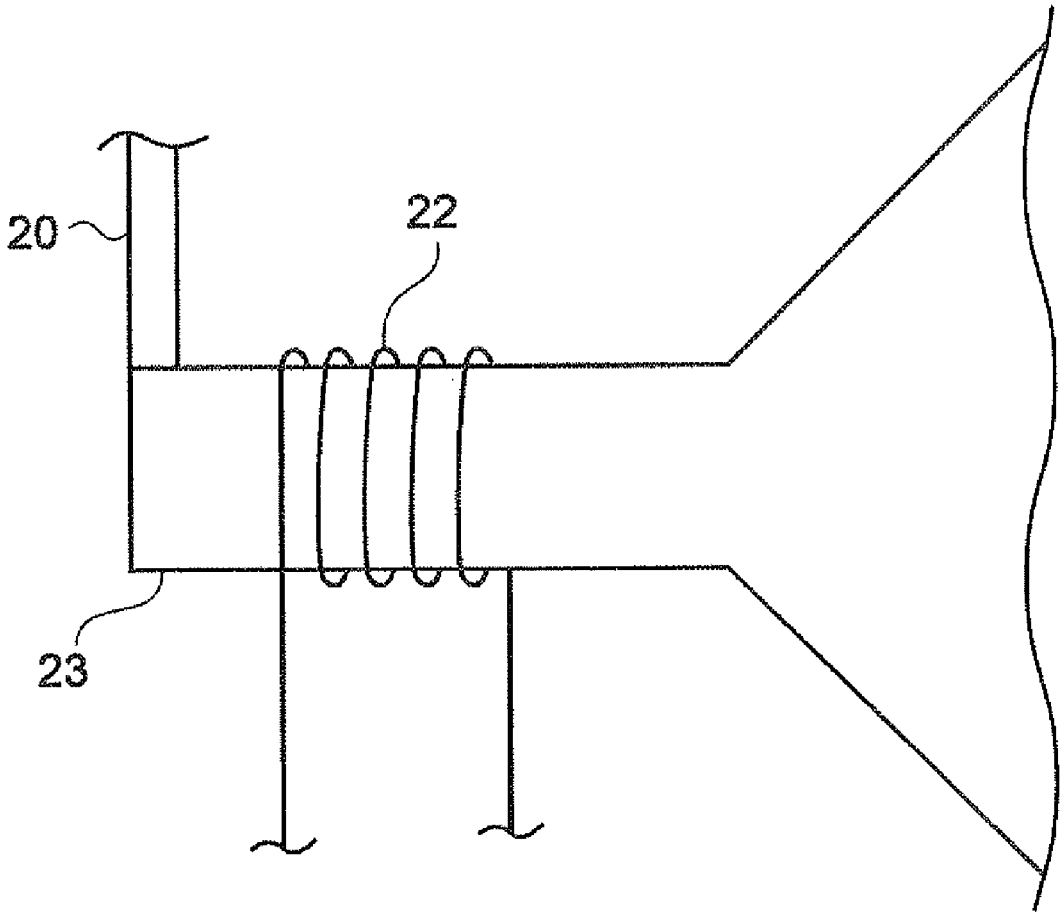
FIG. 6 is a schematic diagram showing an example of a plasma generation device used in formation of a protective layer of the electrophotographic photoreceptor in the exemplary embodiment.

A plasma generation device shown in FIG. 6 may be used in place of the plasma generation device arranged in the film-forming apparatus shown in FIGS. 5A and 5B. FIG. 6 is a schematic diagram showing another example of the plasma generation device used in the film-forming apparatus shown in FIGS. 5A and 5B. In FIG. 6, 22 is a high-frequency coil, 23 is a quartz tube, and 20 is the same as shown in FIG. 5. This plasma generation device includes the quartz tube 23 and the high-frequency coil 22 arranged along the outer periphery of the quarts tube 23, and one end of the quartz tube 23 is connected to the deposition chamber 10 (not shown in FIG. 6). The gas introduction tube 20 for introducing a gas to the quartz tube 23 is connected to the other end of the quartz tube 23.

To the side of the discharge surface of the plate electrode 19 in FIGS. 5A and 513, a shower nozzle 16 that is in the shape of a rod and is disposed so as to be approximately parallel to the discharge surface is connected, and one end of the shower nozzle 16 is connected to the gas introduction tube 15, and the gas introduction tube 15 is connected to a second gas supplying source (not shown) disposed outside of the deposition chamber 10.

The film-forming chamber 10 is provided therein with the base material rotating part 12, and the cylindrical base material 14 is attached to the substrate rotating part 12 via the a substrate supporting member 13 such that the longer direction of the shower nozzle faces so as to be approximately parallel to the axial direction of the base material 14. For film-forming, the base material rotating part 12 is rotated thereby rotating the base material 14 in the circumferential direction. The base material 14 used herein is, for example, a photoreceptor having members up to a photosensitive layer disposed therein, a photoreceptor having members up to a second region disposed on a photosensitive layer, a photoreceptor having members up to a third region disposed on a photosensitive layer, or the like.

Formation of the protective layer may be carried out, for example, in the following manner.

First, an oxygen gas (or a helium (He)-diluted oxygen gas), a helium (He) gas, and if necessary a hydrogen ($H_2$) gas are introduced via a gas introduction tube 20 into a high-frequency discharge tube part 21, and a high-frequency power supplying part 18 supplies a radiofrequency wave at 13.56 MHz to the plate electrode 19. In this case, the plasma diffusion part 17 is formed so as to spread radially from the side of the discharge surface of the plate electrode 19 to the side of the exhaust opening 11. At this time, the gas introduced from the gas introduction tube 20 is passed through the deposition chamber 10 from the side of the plate electrode 19 to the side of the exhaust opening 11. In the plate electrode 19, the electrode may be surrounded with an earth shield.

Then, a trimethyl gallium gas is introduced through the gas introduction tube 15 and the shower nozzle 16 positioned downside from the plate electrode 19 as an activation means, into the deposition chamber 10, thereby forming a gallium- and oxygen-containing non-single-crystal film on the surface of the base material 14.

As the base material 14, a substrate having e.g. a photosensitive layer formed thereon is used.

When, as the second region, a second region containing zinc is formed, for example, a trimethyl gallium gas and an organic zinc (for example, zinc dimethyl or zinc diethyl) gas are used as the gas to be introduced through the gas introduction tube 15. At this time, trimethyl gallium and organic zinc are introduced as gases via different containers into the gas introduction tube 15.

When an organic photoreceptor having an organic photosensitive layer is used, the temperature on the surface of the base material 14 during film-forming of the protective layer is preferably 150° C. or less, more preferably 100° C. or less, and even more preferably from 30° C. to 100° C.

When the temperature of the base material 14 becomes higher than 150° C. by the influence of plasma even if the film-forming initiation temperature of the surface of the base material 14 is 150° C. or less, the organic photosensitive layer may be damaged by heat, and therefore, it is preferable that by consideration of this influence, the surface temperature of this base material 14 is controlled.

When an amorphous silicon photoreceptor is used, the temperature on the surface of the base material 14 during film-forming of the protective layer may be, for example, from 30° C. to 350° C.

The temperature on the surface of the base material 14 may be regulated with a heating unit and/or a cooling unit (not shown) or may be left as it is with natural increase in temperature during discharge. When the base material 14 is heated, a heater may be disposed outside or inside of the base material 14. When the substrate 14 is cooled, a cooling gas or liquid may be circulated inside of the substrate 14.

For suppressing increase in the temperature on the surface of the substrate 14 due to discharge, it may be effective to regulate the gas flow of a high-energy gas flow contacting with the surface of the substrate 14. In this case, conditions such as a gas flow rate, discharge power and pressure are regulated so as to attain predetermined temperature.

Alternatively, any one of aluminum-containing organometallic compounds and hydrides such as diborane may be used in place of the trimethyl gallium gas, and two or more of these materials may be used in combination.

For example, when trimethyl indium gas is introduced through the introduction tube 15 and the shower nozzle 16 into the film-forming chamber 10 in an initial stage of formation of the protective layer thereby forming a nitrogen- and indium-containing film on the base material 14, this film absorbs UV light which is generated when film-forming is performed continuously and which deteriorates the photosensitive layer. Accordingly, damages on the photosensitive layer due to generation of UV light during film-forming may be suppressed.

A dopant may be added to the protective layer in order to regulate its conductivity type.

In the method of doping with a dopant during film-forming, $SiH_3$ or $SnH_4$ for n-type and biscyclopentadiethyl magnesium, dimethyl calcium or dimethyl strontium for p-type may be used in a gaseous state. When the surface layer is doped with dopant elements, any known method such as heat diffusion or ion injection may be used.

Specifically, a gas containing at least one dopant element is introduced via the gas introduction tube 15 and the shower nozzle 16 into the film-forming chamber 10, thereby obtaining the protective layer having a conductivity type such as n-type or p-type.

In the film-forming apparatus described with reference to FIGS. 5 and 6, multiple activation apparatus may be disposed and active nitrogen or active hydrogen formed by discharge energy may be independently regulated, or a gas containing both of nitrogen atoms and hydrogen atoms ($NH_3$ etc.) may be used. In addition, $H_2$ may also be added. Conditions under which active hydrogens are released from the organometallic compound may also be used.

In this manner, activate atoms such as carbon atoms, gallium atoms, nitrogen atoms, hydrogen atoms etc. may be present in a controlled state on the surface of the base material 14. Then, activated hydrogen atoms have an effect of eliminating, as molecules, hydrogens of hydrocarbon groups such as a methyl group and an ethyl group included in the organometallic compound.

Accordingly, a hard film (protective layer) having 3-dimensional bonds may be formed.

In the plasma generation units in the film-forming apparatus shown in FIGS. 5 and 6, a high-frequency generator is used, but the plasma generation unit is not limited thereto, and, for example, a microwave generator, an electro-cyclotron resonance system or a helicon plasma system may be used. When the high-frequency generator is used, it may be either an inducible form or a capacitance type.

Two or more kinds of these units may be used in combination, or two or more units of the same type may be used. For suppressing the increase of the temperature on the surface of the base material 14 by irradiation with plasma, a high-frequency generator is preferable, or a unit for preventing heat irradiation may be arranged.

When two or more different plasma generation devices (plasma generation units) are used, they are preferably configured to discharge simultaneously at the same pressure. Moreover, there may be a difference in pressure between the discharge region and the film-forming region (where the substrate is disposed). These units may be arranged tandemly relative to a gas stream formed in the film-forming apparatus from a part where a gas is introduced into the film-forming apparatus and a part where gas is discharged from the film-forming apparatus. Any one or more of these units may be disposed so as to face the film-forming surface of the substrate.

For example, when two plasma generation units are disposed so as to be tandem relative to the gas stream, the shower nozzle 16 may be used as a second plasma generation device causing discharge in the film-forming chamber 10, for example in the film-forming apparatus shown in FIGS. 5A and B. In this case, for example, a high-frequency voltage is applied via the gas introduction tube 15 to the shower nozzle 16, and the shower nozzle 16 is used as an electrode to cause discharge in the film-forming chamber 10. Alternatively, instead of using the shower nozzle 16 as an electrode, a cylindrical electrode is disposed between the base material 14 in the film-forming chamber 10 and the plate electrode 19, and this cylindrical electrode is used to cause discharge in the film-forming chamber 10.

When two different plasma generation devices are used at the same pressure, for example when a microwave generator and a high-frequency generator are used, the excitation energy of an excited species may be changed largely, which may be effective for controlling film property. Discharge may be carried out in the vicinity of atmospheric pressure (from 70000 Pa to 110000 Pa). In the case of discharge in the vicinity of atmospheric pressure, He may be used as a carrier gas.

In formation of the surface layer etc., besides the methods as described above, the usual organic metal vapor phase growth method or molecular beam epitaxy may be used, and in film-forming by these methods, use of active nitrogen and/or active hydrogen and active oxygen is effect for lowering temperatures. In this case, a gas such as $N_2$, $NH_3$, $NF_3$, $N_2H_4$ or methyl hydrazine, or those obtained by gasifying a liquid or bubbling with a carrier gas may be used as a raw material of nitrogen. As a raw material of oxygen, $H_2O$, CO, $CO_2$, NO or $N_2O$ may be used.

In the formation of the protective layer in the exemplary embodiment, for example, a base material 14 having a photosensitive layer formed on a substrate may be disposed in a film-forming chamber 10, and mixed gases different in composition are introduced into the chamber, thereby continuously forming a second region and a first region successively. If necessary, a third region is formed before formation of the second region. If necessary, an intermediate layer is formed between the second region and the first region.

The regions (or layers) each may be formed separately and independently.

With respect to the film-forming conditions, in the case of discharge, for example, with high-frequency discharge, the frequency is preferably in the range of from 10 kHz to 50 MHz, in order to forming a film of good quality at a low temperature. The output depends on the size of the substrate and is preferably in the range of from 0.01 $W/cm^2$ to 0.2 $W/cm^2$ based on the surface area of the substrate. The number of rotations of the substrate is preferably in the range of from 0.1 rpm to 500 rpm.

The film-forming conditions in each region (or each layer) may be the same condition. For example, the formation of the second region may be conducted with lower output power at low temperature while the formation of the first region may be conducted with higher output power.

Substrate and Photosensitive Layer

The photosensitive layer is a layer disposed between the substrate and the protective layer in the electrophotographic photoreceptor in the exemplary embodiment.

The electrophotographic photoreceptor in the exemplary embodiment is not particularly limited as long as, in its layer structure, the photosensitive layer and the protective layer are disposed on the substrate in this order, and the electrophotographic photoreceptor may include, for example, an undercoat layer between the substrate and the photosensitive layer, if necessary. The photosensitive layer may consist of two or more layers. The photosensitive layer may be of functional separation-type. The electrophotographic photoreceptor in the exemplary embodiment may be an amorphous silicon photoreceptor containing silicon atoms in the photosensitive layer.

In the amorphous silicon photoreceptor, when the protective layer in the exemplary embodiment is used as a surface layer portion, image blurring under high-humidity may be suppressed and both durability and high image quality may be satisfied.

The photoreceptor is preferably an organic photoreceptor in which the photosensitive layer includes an organic material, such as an organic photosensitive material. Although the organic photoreceptor may be liable to abrasion, when the protective layer in the exemplary embodiment is used as a surface portion, abrasion may be suppressed.

First, an outline of the structure of the electrophotographic photoreceptor in the exemplary embodiment, in the case of the electrophotographic photoreceptor is as an organic photoreceptor, will be described.

The organic polymer compound used for the photosensitive layer may be thermoplastic or thermosetting or may be formed by forming two types of molecules. The second region disposed between the photosensitive layer and the first region may have intermediate properties relative to the physical properties of the first region and the physical properties of the photosensitive layer (charge transport layer in the case of functional separation type), from the viewpoint of hardness and expansion coefficient, regulation of elasticity, and improvement of adhesiveness. The second region may also function as a region for trapping charges.

In the case of the organic photoreceptor, the photosensitive layer may be a functional separation type in which the photosensitive layer is separated into a charge generation layer and a charge transport layer as shown in FIGS. 1, 3 and 4 or may be a function integration type as shown in FIG. 2. In the photoreceptor of functional separation type, a charge generation layer may be disposed so as to be closer to the surface of the photoreceptor or a charge transport layer may be disposed so as to be closer to the surface of the photoreceptor.

When the protective layer is formed on the photosensitive layer by the method described above, the surface of the photosensitive layer may be provided with a layer for absorbing short wavelength light such as ultraviolet ray before the formation of the protective layer in order to suppress decomposition of the photosensitive layer due to irradiation with electromagnetic radiation of shorter wavelength other than heat. A layer of small band gap may be initially formed at an initial stage of forming the protective layer in order to prevent the photosensitive layer from being irradiated with a short wavelength light. Preferable examples of the composition of the layer of small band gap disposed at the photosensitive layer side include $Ga_XIn_{1-X}(0 \leq X \leq 0.99)$.

A UV absorber-containing layer (for example, a layer formed by, for example, coating a layer in which a high-molecular-weight resin is dispersed) may be disposed on the surface of the photosensitive layer.

When the UV absorber-containing layer is formed on the surface of the photoreceptor before formation of the protective layer, it is possible to reduce the influence, on the photosensitive layer, of short wavelength lights such as UV ray in formation of the protective layer, corona discharge when the photoreceptor is used in the image forming apparatus, and UV ray from various light sources.

Next, an outline of the structure of the electrophotographic photoreceptor in the exemplary embodiment, in the case of the electrophotographic photoreceptor is an amorphous silicon photoreceptor, will be described.

The amorphous silicon photoreceptor may be a photoreceptor for positive charging or a photoreceptor for negative charging.

For example, a photoreceptor in which a charge injection blocking layer (undercoat layer), a photoconductive layer, and a charge injection blocking surface layer are disposed in on the substrate this order, may be used.

In this case, the protective layer in the exemplary embodiment is formed on the charge injection blocking surface layer.

The outermost layer (later at the side of the protective layer) of the photosensitive layer may be, for example, a p-type amorphous silicon layer, an n-type amorphous silicon layer, an $Si_XO_{1-X}$: H layer, an $Si_XN_{1-X}$: H layer, an $Si_XC_{1-X}$: H layer, an amorphous carbon layer, or the like.

Next, the substrate and the photosensitive layer included in the electrophotographic photoreceptor in the exemplary embodiment, and the undercoat layer disposed as necessary, will be described in detail with reference to an organic photoreceptor having a functional separation type photosensitive layer in the electrophotographic photoreceptor.

—Substrate—

As the substrate, an electroconductive substrate is used.

The term "electroconductive" in the specification refers to the property of a volume resistivity of less than $10^{13}$ Ω·cm, and the term "insulating" refers to the property of a volume resistivity of $10^{13}$ Ωcm or more.

Examples of the electroconductive substrate include metal drums such as drums of any of aluminum, copper, iron, stainless steel, zinc and nickel; those obtained by vapor-depositing a metal such as aluminum, copper, gold, silver, platinum, palladium, titanium, nickel-chrome, stainless steel, or copper-indium on a substrate such as a sheet, paper, plastic and glass; those obtained by depositing an electroconductive metal compound such as indium oxide or tin oxide on any of the above substrates; those having a metal foil laminated on any of the above substrate; and those obtained by dispersing carbon black, indium oxide, tin oxide-ammonium oxide powder, metal oxide or copper iodine in a binder resin and then applying the dispersion onto the above substrate, thereby electroconductively treating them. The shape of the substrate may be cylindrical.

When a metallic pipe substrate is used as an electroconductive substrate, the surface of the metallic pipe substrate may be untreated, or the surface of the substrate may be previously roughened by surface treatment. When the surface of the metallic pipe substrate is roughened, grain-shaped density evenness due to interference light which may be generated inside of the photoreceptor in the case that a coherent light source such as laser beam is used as an exposure light source, may be suppressed. Examples of the method of surface treatment include mirror face polishing, etching, anodizing, rough grinding, centerless grinding, sand blasting and wet honing.

In respect of improvement in adhesiveness to the photosensitive layer and improvement in film-forming, a substrate obtained by subjecting the surface of an aluminum substrate to anodizing is preferably used as an electroconductive substrate.

Hereinafter, the method of producing an electroconductive substrate the surface of which has been subjected to anodizing will be described.

First, pure aluminum or an aluminum alloy (for example, aluminum or aluminum 1000s, 3000s, and 6000s alloys stipulated in JISH4080, the disclosure of which is incorporated by reference herein) is prepared. Then, anodizing treatment is performed thereon. The anodizing is conducted in an acidic bath of, for example, chromic acid, sulfuric acid, oxalic acid, phosphoric acid, boric acid or sulfamic acid, among which a sulfuric acid bath is often used. The anodizing treatment may be carried out under the conditions of, for example, a sulfuric acid concentration of from 10 to 20% by weight, a bath temperature of from 5 to 25° C., a current density of from 1 to 4 A/dm$^2$, and an electrolysis voltage of from 5 to 30 V and a treatment time of from 5 minutes to 60 minutes, but the anodizing treatment is not limited to the above described conditions.

The anodized film formed on the aluminum substrate in this manner is porous, and since the anodized film formed in this manner is highly insulating, and the surface thereof is very instable, changes with time in its physical properties after formation of the film may easily occur. For suppressing changes in the physical properties, the anodizing film may further be subjected to sealing. Examples of the method of sealing treatment include a method of dipping an anodized film in an aqueous solution containing nickel fluoride or nickel acetate, a method of dipping an anodized film in boiling water, and a method of treatment with pressurized steam. Among these methods, the method of dipping into an aqueous solution containing nickel acetate is most often used.

On the surface of the anodized film thus subjected to sealing, a metal salt and the like adhered by the sealing treatment remain in large excess. When the metal salt and the like remain in large excess on the anodized substrate, qualities of the coating film fowled on the anodized film may be adversely affected, and generally low-resistant components tend to remain, so that when this substrate is used as a photoreceptor to form an image, the occurrence of scumming may be caused.

Accordingly, following the sealing treatment, washing of the anodized film for removing the metal salt etc. adhered in the sealing treatment may be performed. The washing treatment may be performed by washing the substrate only once with purified water, but the substrate is preferably washed by performing multiple washing steps. In this case, a washing liquid in the final washing step is, for example, a deionized washing liquid. In one step of the multiple washing steps, physiologically scrubbing washing with a contacting member such as a brush is preferably performed.

The thickness of the anodized film on the surface of the electroconductive substrate formed in this manner is preferably in the range of from 3 μm to 15 μm. On the anodizing film, there is a layer called a barrier layer along a very surface of the porous anodized film in a porous shape. The film thickness of the barrier layer is preferably in the range of from 1 nm to 100 nm in the electrophotographic photoreceptor in the exemplary embodiment. In this manner, the anodized electroconductive substrate is obtained.

In the electroconductive substrate obtained in this manner, the anodized film formed on the substrate by anodizing has high carrier blocking property. Accordingly, when the photoreceptor in which the electroconductive substrate is used is fit to an image forming apparatus and reversal development (color negative development) is performed, point defects (black spotting and scumming) may be suppressed. Further phenomenon of current leak from a contact charger, which easily occurs during contact charging, may be suppressed. By subjecting sealing treatment to the anodized film, changes with time in physical properties of anodized film after production may be suppressed. By washing the electroconductive substrate after sealing, metal salts etc. adhered to the surface of the electroconductive substrate by the sealing treatment may be removed, and when an image is formed by an image forming apparatus provided with the photoreceptor prepared using this electroconductive substrate, occurrence of scumming may be suppressed.

—Undercoat Layer—

Then, the undercoat layer will be described. Examples of a material used for the undercoat layer include polymer resin compounds, for example, acetal resin such as polyvinyl butyral, as well as polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicone resin, silicone-alkyd resin, phenol-formaldehyde resin, melamine resin, and organometallic compounds containing a metal atom such as zirconium, titanium, aluminium, manganese and silicon atoms.

One of these compounds may be used singly or two or more of these compounds may be used in as a mixture or polycondensate thereof. Of those, organometallic compounds containing zirconium or silicon are preferred in point of their property in that their residual potential is low, their potential change depending on the environment is small, and their potential change in repeated use is also small. One kind of the organometallic compounds may be used singly or two or more kinds thereof may be used as a mixture. The organometallic compound may be mixed with the binder resin described above.

Examples of an organic silane compound (silicon atom-containing organometallic compound) includes vinyltrimethoxysilane, γ-methaeryloxypropyl-tris(β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-aminoethyl)-γ-aminopropylmethylmethoxysilane, N,N-bis(β-hydroxyethyl)-γ-aminopropyltriethoxysilane, and γ-chloropropyltrimethoxysilane. Preferable examples of the organic silane compound include silane coupling agents such as vinyltriethoxylsilane, vinyltris (2-methoxyethoxy)silane, 3-methacryloxypropyltrimethoxysilane, 3-glycidoxypropyltrimethoxysilane, 2(3,4-epoxycyclohexypethyltrimethoxysilane, N-2-(aminoethyl)-3-aminopropyltrimethoxysilane, N-2-(aminoethyl)-3-aminopropylmethyldimethoxysilane, 3-aminopropyltriethoxylsilane, N-phenyl-3-aminopropyltrimethoxysilane, 3-mercaptopropyltrimethoxysilane, and 3-chloropropyl trimethoxysilane.

Further, examples of the undercoat layers include known undercoat layers such as undercoat layers described in, for example, paragraphs 0113 to 0136 in JP-A No. 2008-076520.

—Photosensitive Layer: Charge Transport Layer—

Next, the photosensitive layer will be described. The explanation will be divided in to the explanation of a charge transport layer and that of a charge generation layer. At first the charge transport layer will be described and then the charge generation layer will be described.

Examples of a charge transport material used in the charge transport layer include the following compounds: That is, the hole transporting materials used herein include, for example, oxadiazole derivatives such as 2,5-bis(p-diethylaminophenyl)-1,3,4-oxadiazole; pyrazoline derivatives such as 1,3,5-triphenyl-pyrazoline, 1-[pyridyl-(2)]-3-(p-diethylaminostyryl)-5-(p-diethylaminostyryl)pyrazoline; aromatic tertiary amino compounds such as triphenylamine, tri(p-methyl)phenylamine, N,N-bis(3,4-dimethylphenyl)biphenyl-4-amine, dibenzylaniline, 9,9-dimethyl-N,N-di(p-tolyl)fluorenon-2-amine; aromatic tertiary diamino compounds such as N,N'-diphenyl-N,N'-bis(3-methylphenyl)-[1,1-biphenyl]-4,4'-diamine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone, 4-diphenylaminobenzaldehyde-1,1-diphenylhydrazone, [p-(diethylamino)phenyl](1-naphthyl) phenylhydrazone, 1-pyrenediphenylhydrazone, 9-ethyl-3-[(2-methyl-1-indolinylimino)methyl]carbazole, 4-(2-methyl-1-indolinyliminomethyl)triphenylamine, 9-methyl-3-carbazole-diphenylhydrazone, 1,1-di-(4,4'-methoxyphenyl)acrylaldehyde-diphenylhydrazone, and β,β-bis(methoxyphenyl)vinyldiphenylhydrazone; quinazoline derivatives such as 2-phenyl-4-styrylquinazoline; benzofuran derivatives such as 6-hydroxy-2,3-di(p-methoxyphenyl)benzofuran; α-stilbene derivatives such as p-(2,2-diphenylvinyl)-N,N-diphenylaniline; enamine derivatives; carbazole derivatives such as N-ethylcarbazole; and poly-N-vinylcarbazole and its derivatives. Examples of the charge transport material further include polymers containing, in their main or side chains, a group containing any of the above compounds. One kind of these charge transport materials may be used singly or two or more kinds of these charge transport materials may be used in combination.

Although the binder resin used in the charge transport layer is not particularly limited, the binder resin may desirably have compatibility with particularly the charge transport material and has suitable strength having.

Examples of the binder resin include various polycarbonate resins (or their copolymers) containing bisphenol A, bisphenol Z, bisphenol C, bisphenol TP etc., polyarylate resins and its copolymers, polyester resins, methacrylic resins, acrylic resins, polyvinyl chloride resins, polyvinylidene chloride resins, polystyrene resins, polyvinyl acetate resins, styrene-butadiene copolymer resins, vinyl chloride-vinyl acetate copolymer resins, vinyl chloride-vinyl acetate-maleic acid anhydride copolymer resins, silicone resins, silicone-alkyd resins, phenol-formaldehyde resins, styrene-acryl copolymer resins, styrene-alkyd resins, poly-N-vinylcarbazole resins, polyvinyl butyral resins, and polyphenylene ether resins. One of these resins may be used singly or a mixture of two or more kinds of these resins may be used.

The molecular weight of the binder resin used in the charge transport layer may be selected depending on the layer thickness of a photosensitive layer or the film-forming conditions such as a solvent, and usually the viscosity average molecular weight is preferably in the range of from 3,000 to 300,000, and more preferably from 20,000 to 200,000.

The charge transport layer may be formed by coating a solution obtained by dissolving the charge transport material and the binder resin in a suitable solvent, and drying the coating. Examples of the solvent used in forming a charge transport layer-forming liquid include aromatic hydrocarbons such as benzene, toluene and chlorobenzene, ketones such as acetone and 2-butanone, halogenated aliphatic hydrocarbons such as methylene chloride, chloroform and ethylene chloride, cyclic or linear ethers such as tetrahydrofuran, dioxane, ethylene glycol and diethyl ether, and mixed solvents thereof. Generally, the mixing ratio of the charge transport material to the binder resin is preferably in the range of from 10:1 to 1:5. Generally, the layer thickness of the charge transferring layer is preferably in the range of from 5 μm to 50 μm, more preferably in the range of from 10 μm to 40 μm.

The charge transport layer and/or the charge generation layer described later may contain one or more additives such as an antioxidant, a photostabilizer and a heat stabilizer for the purpose of suppressing the deterioration of the photoreceptor with ozone or an oxidizing gas in an image forming apparatus or with light or heat.

Examples of the antioxidant include hindered phenol, hindered amine, paraphenylene diamine, aryl alkane, hydroquinone, spirochromane, spiroindanone or their derivatives, organic sulfur compounds, organic phosphorus compounds etc.

The charge transport layer may be formed, for example, by coating a solution in which the charge transport material and the binder resin as described above have been dissolved in a suitable solvent, and drying the coating. Examples of the solvent used in preparation of the charge transport layer-forming liquid include aromatic hydrocarbons such as benzene, toluene and chlorobenzene, ketones such as acetone and 2-butanone, halogenated aliphatic hydrocarbons such as methylene chloride, chloroform and ethylene chloride, cyclic or linear ethers such as tetrahydrofuran, dioxane, ethylene glycol and diethyl ether, and mixed solvents thereof.

A silicone oil may be added as a leveling agent to the charge transport layer-coating liquid in order to improve the smoothness of a coating film formed by coating.

The mixing ratio of the charge transport material to the binder resin, in terms of ratio by weight, is preferably from 10:1 to 1:5. The layer thickness of the charge transport layer is preferably in the range of from 5 μm to 50 μm, more preferably in the range of from 10 μm to 30 μm.

Depending on the shape or use of the photoreceptor, coating of the charge transport layer-forming coating liquid is carried out by using a coating method such as dipping coating, ring coating, spray coating, bead coating, blade coating, roller coating, knife coating or curtain coating. Drying is conducted preferably by set to touch at room temperature (for example, from 20° C. to 30° C.) and subsequent drying by heating. The dying by heating is desirably conducted at a temperature in the range of from 30° C. to 200° C. for a time in the range of from 5 minutes to 2 hours.

Examples of the charge transport layer further include known charge transport layers such as charge transport layers described in, for example, paragraphs from 0137 to 0150 in JP-A No. 2008-076520.

—Photosensitive Layer: Charge Generation Layer—

The charge generation layer may be formed by vapor-depositing a charge generation material by vacuum deposition or by coating a solution containing an organic solvent and a binder resin.

Examples of the charge generation material include amorphous selenium, crystalline selenium, selenium-tellurium alloy, selenium-arsenic alloy, and other selenium compounds; inorganic photoconductors such as selenium alloys, zinc oxide and titanium oxide; and those obtained by sensitizing any of the above described compounds with a dye, various phthalocyanine compounds, e.g., metal-free phthalocyanine, titanylphthalocyanine, copper phthalocyanine, tin phthalocyanine and gallium phthalocyanine; various organic pigments such as squarylium pigments, anthanthrone pigments, perylene pigments, azo pigments, anthraquinone pigments, pyrene pigments, pyrylium salts, and thiapyrylium salts; and dyes.

These organic pigments generally have some different crystal forms. In particular, phthalocyanine compounds are known to have various crystal forms such as α-form and β-form. Any of these crystal forms are usable herein so far as the pigments may bring about sensitivity and other characteristics necessary for the purpose.

Among the charge generation materials described above, phthalocyanine compounds are preferable. In this case, when the photosensitive layer is irradiated with light, the phthalocyanine compound contained in the photosensitive layer absorbs photons to generate carriers. At this time, the phthalocyanine compound has high quantum efficiency and thus efficiently absorbs photons to generate carriers.

Among these phthalocyanine compounds, preferable examples thereof include phthalocyanines shown in the following (1) to (3) is more preferable.

(1) Hydroxygallium phthalocyanine with a crystal form having diffraction peaks at a Bragg angle)(2θ±0.2°) of at least 7.6°, 10.0°, 25.2° and 28.0° in the X-ray diffraction spectrum thereof with a Cukα ray, as a charge generation material.

(2) Chlorogallium phthalocyanine with a crystal form having diffraction peaks at a Bragg angle)(2θ±0.2°) of at least 7.3°, 16.5°, 25.4° and 28.1° in the X-ray diffraction spectrum thereof with a Cukα ray, as a charge generation material.

(3) Titanylphthalocyanine with a crystal form having diffraction peaks at a Bragg angle) (2θ±0.2°) of at least 9.5°, 24.2° and 27.3° in the X-ray diffraction spectrum thereof with a Cukα ray, as a charge generation material.

In particular, these phthalocyanine compounds have high photosensitivity and the photosensitivity thereof is highly stable. Accordingly, a photoreceptor including a photosensitive layer including such a phthalocyanine compound is preferably used as a photoreceptor of a color image forming apparatus in which rapid image forming and repeated reproducibility are required.

Depending on their crystal form and the method for analyzing them, these materials may give peaks that are slightly shifted from the above-mentioned peak data, but it is judged that the materials having substantially the same X-ray diffraction pattern have the same crystal form.

Examples of the binder resin used in the charge generation layer include those described below.

That is, examples of the binder resin include polycarbonate resins such as bisphenol A or bisphenol Z and its copolymers, polyarylate resins, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicone-alkyd resins, phenol-formaldehyde resin, styrene-alkyd resins, and poly-N-vinylcarbazole resin.

One of these binder resins may be used singly or two or more kinds may be used as a mixture. The compounding ratio of the charge generation material to the binder resin (charge generation material:binder resin), in terms of ratio by weight, is desirably in the range of from 10:1 to 1:10. The thickness of the charge generation layer is generally desirably in the range of from 0.01 μm to 5 μm, more desirably in the range of from 0.05 μm to 2.0 μm.

The charge generation layer may contain at least one electron accepting material for the purpose of improvement of sensitivity, reduction in residual voltage, reduction in fatigue in repeated use, etc. Examples of Such electron accepting material used in the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid and phthalic acid. Among these, particularly preferred are a fluorenone compound, a quinone compound and a benzene derivative having an electron attracting substituent such as Cl, CN or $NO_2$.

Examples of the method of dispersing the charge generation material in a resin include methods with a roll mill, a ball mill, a vibratory ball mill, an attritor, a Dyno mill, a sand mill and a colloid mill.

Examples of known organic solvents as solvents in a coating solution for forming a charge generation layer include aromatic hydrocarbon solvents such as toluene and chlorobenzene, aliphatic alcohol solvents such as methanol, ethanol, n-propanol, iso-propanol and n-butanol, ketone solvents such as acetone, cyclohexanone and 2-butanone, halogenated aliphatic hydrocarbon solvents such as methylene chloride, chloroform and ethylene chloride, cyclic or linear ether solvents such as tetrahydrofuran, dioxane, ethylene glycol and diethyl ether, and ester solvents such as ethyl acetate, ethyl acetate and n-butyl acetate.

One kind of these solvents may be used singly or two or more kinds of these solvents may be used as a mixture. When two or more solvents are used as a mixture, for example, as the mixed solvents may dissolve a binder resin. However, when the photosensitive layer has a layer structure having a charge transport layer and a charge generation layer in this order from the electroconductive substrate side and the charge generation layer is formed by using a coating method such as dipping coating by which the lower layer may be easily dissolved, a solvent not dissolving a lower layer such as a charge transport layer is desirably used. When a spray coating method or a ring coating method with relatively less corrosion against the lower layer is used to form a charge generation layer, the solvent can be selected from a broader range.

<Process Cartridge and Image Forming Apparatus>

Then, the process cartridge and the image forming apparatus, in which the electrographic receptor in the exemplary embodiment is used, will be described.

The process cartridge in the exemplary embodiment is not particularly limited as long as the electrophotographic photoreceptor in the exemplary embodiment is used therein. Specifically, the process cartridge includes the electrophotographic photoreceptor in the exemplary embodiment and at least one unit selected from a charging unit, a developing unit and a cleaning unit, as one unit, and the process cartridge is attachable to and detachable from the main body of the image forming apparatus.

The image forming apparatus in the exemplary embodiment is not particularly limited as long as the electrophotographic photoreceptor in the exemplary embodiment is used therein. Specifically, the image forming apparatus includes the electrophotographic photoreceptor in the exemplary embodiment, a charging unit that charges the surface of the electrophotographic photoreceptor, an exposure unit (electrostatic latent image forming unit) that exposes the surface of the electrophotographic photoreceptor charged with the charging unit, a developing unit that develops the electrostatic latent image with a developer containing a toner to form a toner image, and a transfer unit that transfers the toner image onto a recording medium. The image forming apparatus in the exemplary embodiment may be a tandem apparatus including plural photoreceptors corresponding to the respective colors, and in this case, all the photoreceptors are preferably the electrophotographic photoreceptor in the exemplary embodiment. Transfer of the toner image may be an intermediate transfer system using an intermediate transfer medium.

The process cartridge or the image forming apparatus in the exemplary embodiment is provided with the electrophotographic photoreceptor of the exemplary embodiment with which reduction in sensitivity may be suppressed, and therefore, decrease in image density attributable to reduction in sensitivity of the electrophotographic photoreceptor may be suppressed.

Figure 7:
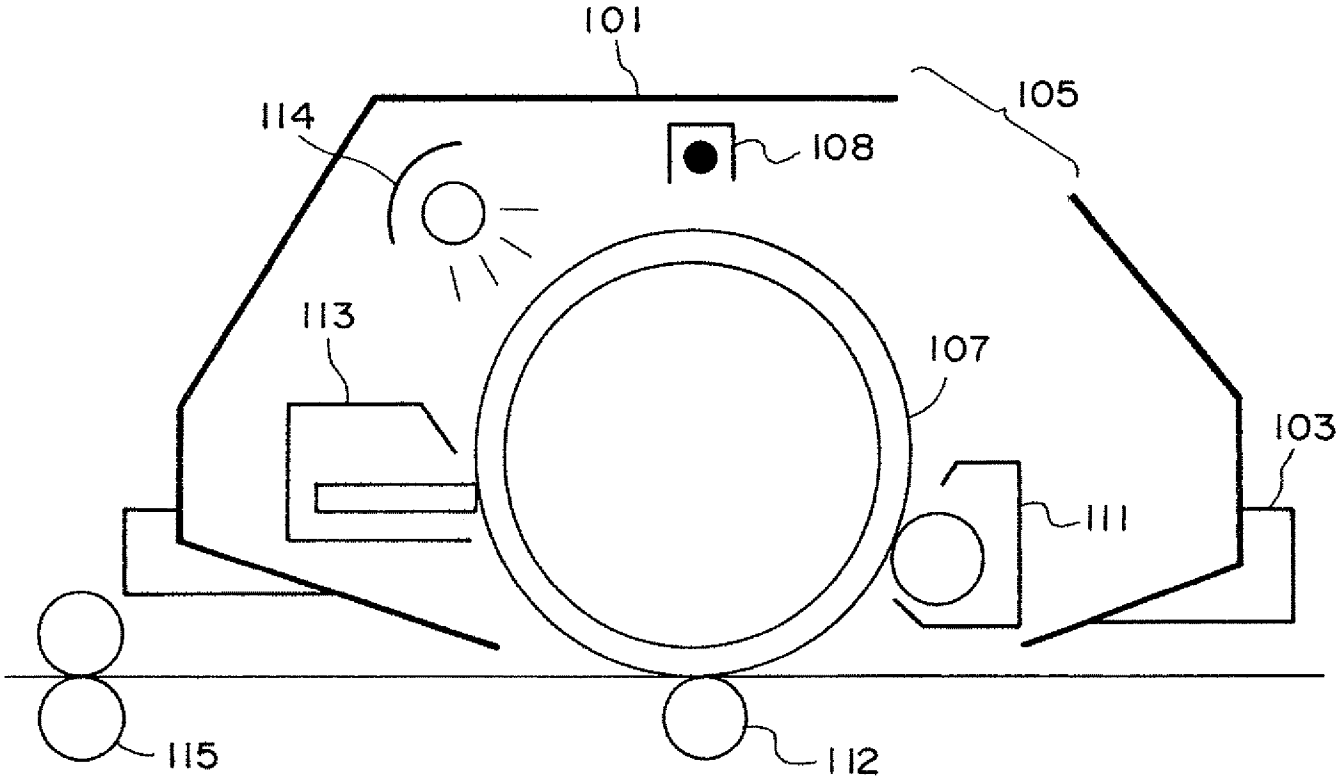
FIG. 7 is a schematic diagram showing one example of the basic structure of the process cartridge in the exemplary embodiment.

FIG. 7 is a schematic view showing one example of the basic structure of the process cartridge in the exemplary embodiment.

The process cartridge 100 shown in FIG. 7 includes an electrophotographic photoreceptor 107, a charging unit 108, a developing unit 111, a cleaning unit 113, and an opening 105 for exposure, and a charge eraser 114, which are integrated with one another with a case 101 and a mounting rail 103. The process cartridge 100 is attachable to and detachable from the main body of the image forming apparatus including a transfer unit 112, a fixing device 115, and other component parts which are not illustrated, and together with the main body of the electrophotgraphic apparatus, forms the image forming apparatus.

Figure 8:
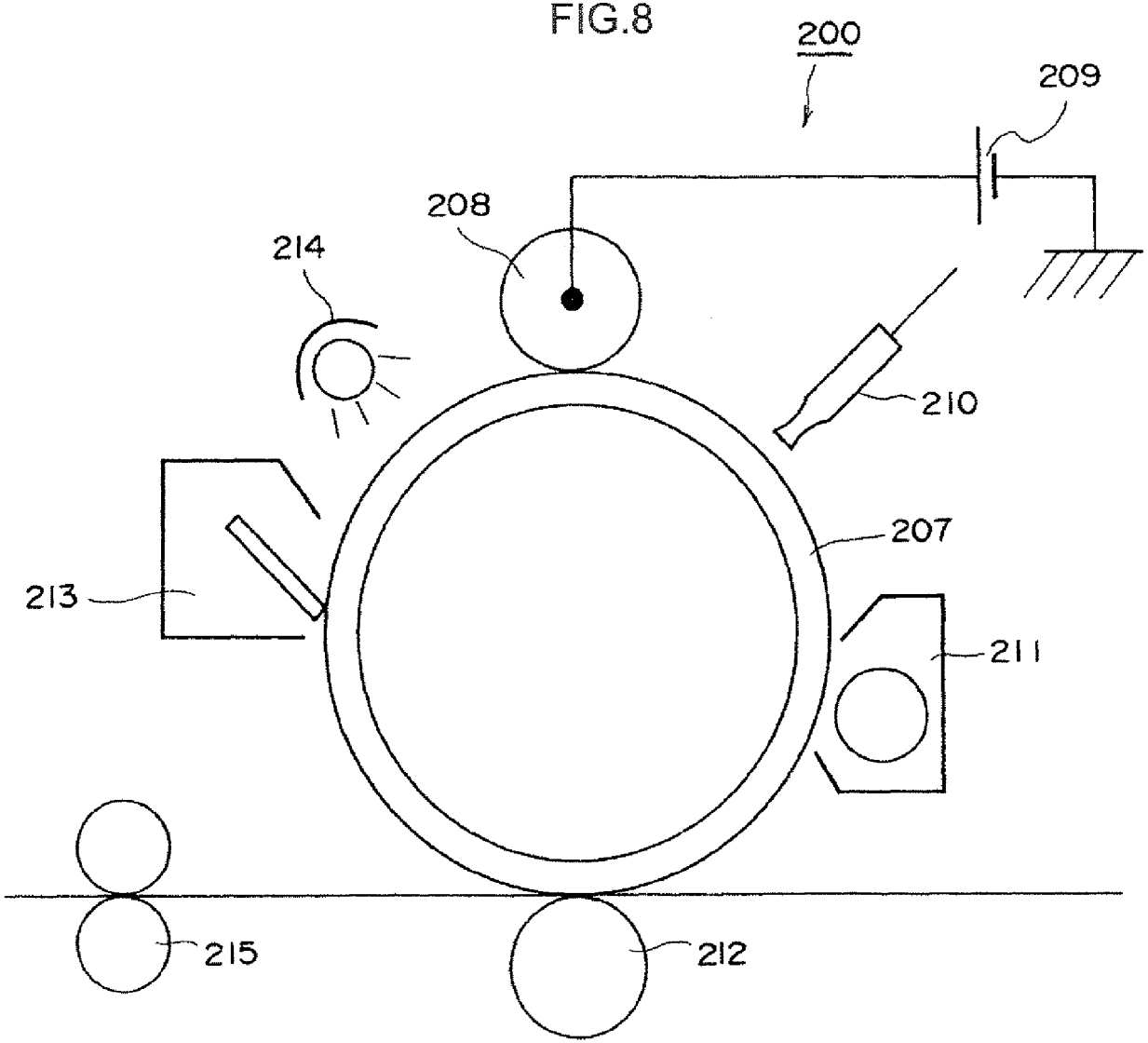
FIG. 8 is a schematic diagram showing one example of the basic structure of the image forming apparatus in the exemplary embodiment.

FIG. 8 is a schematic view showing one example of the basic structure of the image forming apparatus in the exemplary embodiment.

The image forming apparatus 200 shown in FIG. 8 includes an electrophotographic photoreceptor 207, a charging unit 208 that charges the electrophotographic photoreceptor 207 by a contact system, a power supply 209 connected to the charging unit 208, an exposure unit 210 that exposes the electrophotographic photoreceptor 207 charged with the charging unit 208, a developing unit 211 that develops the portion exposed using the exposure unit 210, a transfer unit 212 that transfers the image developed on the electrophotographic photoreceptor 207 by the developing unit 211, a cleaning unit 213, a charge eraser 214, and a fixing device 215.

The process cartridge in the exemplary embodiment, or the cleaning unit of the electrophotographic photoreceptor in the image forming apparatus, is not particularly limited but is preferably a cleaning blade. The cleaning blade as compared with other cleaning units may damage the surface of the photoreceptor or promotes abrasion more easily. However, the process cartridge in the exemplary embodiment and the image forming apparatus in the exemplary embodiment employ, as their photoreceptor, the electrophotographic photoreceptor in the exemplary embodiment, scratching and abrasion on the surface of the photoreceptor may be suppressed, even when these are used for a long period of time.

EXAMPLES

Hereinafter, the present invention will be described with reference to the Examples, but the invention is not limited to these examples. In the Examples that below, the term "part(s)" mean part(s) by weight.

Example 1

Preparation of Electrophotographic Photoreceptor

First, an organic photoreceptor in which an undercoat layer, a charge generation layer and a charge transport layer are formed in this order on an aluminum (Al) substrate by the procedure described below, is prepared.

<Formation of Undercoat Layer>

A solution obtained by mixing 20 parts by weight of a zirconium compound (trade name: ORGATICS ZC540, manufactured by Matsumoto Chemical Industry Co., Ltd.), 2.5 parts by weight of a silane compound (trade name: A1100, manufactured by Nippon Unicar Co., Ltd.), 10 parts by weight of a polyvinyl butyral resin (trade name: S-LEC BM-S, manufactured by Sekisui Chemical Co., Ltd.), and 45 parts by weight of butanol and stirring is applied onto the surface of an Al substrate having an outer diameter of 84 mm, followed by drying under heating at 150° C. for 10 minutes, whereby an undercoat layer having a layer thickness of 1.0 μm is formed.

<Formation of Charge Generation Layer>

Then, 1 part by weight of chlorogallium phthalocyanine as a charge generation material is mixed with 1 part by weight of polyvinyl butyral (trade name: S-LEC BM-S, manufactured by Sekisui Chemical Co., Ltd.) and 10 parts by weight of n-butyl acetate, to give a mixture, and the resulting mixture, together with glass beads, is dispersed in a paint shaper for 1 hour, to give a charge generation layer-forming dispersion liquid.

The dispersion liquid is applied by dipping on an undercoat layer, then dried at 100° C. for 10 minutes, to form a charge generation layer having a layer thickness of 0.15

<Formation of Charge Transport Layer>

Then, 2 parts by weight of a compound represented by the following structural formula (1) and 3 parts by weight of a high-molecular-weight compound (viscosity-average molecular weight: 39000) having a repeating unit represented by the following structural formula (2) are dissolved in 20 parts by weight of chlorobenzene to prepare a charge transport layer-forming coating liquid.

Structural Formula (1)

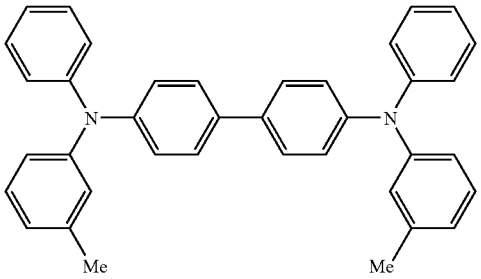

Structural Formula (2)

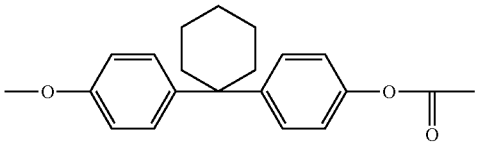

This coating liquid is applied by dipping onto the charge generation layer and heated at 110° C. for 40 minutes to form a charge transport layer having a layer thickness of 20 μm. Accordingly, an organic photoreceptor (also referred to hereinafter as "uncoated photoreceptor (1)") in which an undercoat layer, a charge generation layer and a charge transport layer are disposed in this order on the Al substrate is obtained.

<Formation of Protective Layer>

(Formation of Second Layer)

Formation of a second layer on the surface of the uncoated photoreceptor (1) is carried out with a film-forming apparatus having the structure shown in FIGS. 5A and 5B.

First, the uncoated photoreceptor (1) is placed on a substrate supporting member 13 in a film-forming chamber 10 in the film-forming apparatus, and then the film-forming chamber 10 is evacuated via a discharge opening 11 until the pressure therein is reduced to 0.1 Pa.

Then, an He-diluted 20% oxygen gas (20 sccm), an He gas (100 sccm), and an $H_2$ gas (500 sccm) are introduced via a gas introduction tube 20 into a high-frequency discharge tube part 21 provided with an electrode 19 of 50 mm in thickness, and, by a high-frequency power source 18 and a matching circuit (not shown in FIG. 5), a radiofrequency wave of 13.56 MHz is set at an output of 100 W while matching is made by a tuner, discharging is carried out from the electrode 19. The reflected wave at this time is 0 W.

Then, a trimethyl gallium gas (3 sccm) is introduced via a gas introduction tube 15 by a shower nozzle 16 into a plasma diffusion part 17 in the film-forming chamber 10. At this time, the reaction pressure in the film-forming chamber 10, as determined with a BARATON vacuum meter, is 40 Pa.

In this state, while the uncoated photoreceptor (1) is rotated at a rate of 100 rpm, film-forming is performed for 120 minutes, thereby a second layer having a layer thickness of 3.5 μm is formed on the surface of the charge transfer layer of the uncoated photoreceptor (1).

(Formation of First Layer)

Then, the high-frequency discharge is stopped, then the flow rate of He-diluted 20% oxygen gas is changed to 1 sccm, and then the high-frequency discharge starts again.

In this state, the uncoated photoreceptor (1) having the second layer formed thereon is rotated at a rate of 100 rpm and simultaneously film-forming is performed for 30 minutes, thereby a first layer having a layer thickness of 0.3 μm is formed on the surface of the second layer.

In this manner, an electrophotographic photoreceptor having a second layer and a first layer in this order as the protective layer on the uncoated photoreceptor (1) (electrophotographic photoreceptor provided with the protective layer) is obtained.

For film-forming of the protective layer (the second layer and the first layer), the uncoated photoreceptor (1) is not subjected to heating treatment. A temperature measuring sticker (trade name: TEMP PLATE P/N101, manufactured by Wahl) is stuck on the surface of the uncoated photoreceptor before the film-forming, for monitoring the temperature during film-forming, and after film-forming of the first layer, the temperature is 45° C. according to the temperature measuring sticker.

The layer thickness of the first layer and the layer thickness of the second layer are measured by using the following analysis sample film by a measurement of difference in level with a contact-pin.

A substrate used for the analysis sample film is a Si wafer of 400 μm in thickness cut in a size of 5 mm×10 mm.

A polyimide adhesive tape is stuck on a part the surface of the Si wafer, and on the surface of the side of the wafer the side at on which the adhesive tape was stuck, the analysis sample film of the first layer is formed under substantially the same conditions as in the film-forming of the first layer.

Then, the adhesive tape is removed, and thereby the surface of the Si substrate has a non-film region (region to which the adhesive tape is stuck and removed) and a film-stuck region (region to which the adhesive sheet is not stuck).

Then, the difference in level between the non-film region and the film-stuck region is measured with a device for measuring a difference in level with a contact-pin (trade name: SURFCOM 550 A, manufactured by Tokyo Seimitu Co., Ltd.), thereby determining the layer thickness of the first layer.

The layer thickness of the second layer is also determined in substantially the same manner as for the layer thickness of the first layer.

(Analysis and Evaluation of First Layer)

The analysis sample film is formed on an Si substrate of 300 μm in thickness under substantially the same conditions as in the film-forming of the first layer.

The first layer (sample film) thus formed is measured for its film composition by Rutherford back scattering (RBS) and hydrogen forward scattering (HFS).

The ratio of the number of atoms O/Ga and the hydrogen content (ratio of the number of H atoms to the total numbers of Ga, O and H atoms; % by atom) are as shown in Table 1.

A diffraction image obtained by measurement by reflection high energy electron diffraction (RHEED) shows no dot or line, and the first layer is found to be amorphous.

Further, the surface of the first layer (sample film) does not get scratched when rubbed with stainless steel.

Then, the sample film is formed on a quartz substrate of 0.5 mm in thickness under substantially the same conditions as in the film-forming of the first layer, and the coloration is checked visually. The first layer is colored lightly brown.

The transmittance at 780 nm of the first layer formed on the quartz substrate is measured with an ultraviolet-visible automatic spectrophotometer (Hitachi), and the transmittance thus measured is 95%.

(Analysis and Evaluation of Second Layer)

The second layer is analyzed and evaluated in substantially the same manner as in analysis and evaluation of the first layer.

The ratio of the number of atoms O/Ga and the hydrogen content (ratio of the number of H atoms to the total numbers of Ga, O and H atoms; % by atom) are as shown in Table 1.

A diffraction image obtained by measurement by reflection high energy electron diffraction (RHEED) shows no dot or line, and the second layer is found to be amorphous.

As a result of ultraviolet-visible absorption measurement, the band gap of the second layer is 4.4 eV.

The surface of the second layer does not get scratched when scrubbed with stainless steel.

The second layer formed on a quartz substrate is transparent, and its transmittance at 780 nm is 95%.

Evaluation

The prepared electrophotographic photoreceptor provided with a protective layer is evaluated under the following criteria. Evaluation results are shown in FIG. 1.

<Residual Potential>

First, each of the electrophotographic photoreceptor (uncoated photoreceptor) before formation of the protective layer is subjected to light irradiation, using an exposure light (light source: semiconductor laser; wavelength of 780 mm; output 5 mW), while the surface of the photoreceptor is scanned, the photoreceptor is rotated at 40 rpm and the photoreceptor is negatively charged at −700 V with a scorotron charger. Thereafter, the surface residual potential is measured.

As a result, the residual potential of the uncoated photoreceptor is −10 V, while the residual potential of the photoreceptor with the protective layer is −70 V or less.

<Reduction in Sensitivity by Presence of Protective Layer>

First, the electrophotographic photoreceptor provided with a protective layer is negatively charged at −700 V using the scorotron charger.

Then, the negatively charged electrophotographic photoreceptor provided with a protective layer is irradiated with an exposure light (light source: semiconductor laser, wavelength 780 nm, output 5 mW) to erase charges, and the potential decay rate per unit light dose ($V \cdot m^2/mJ$) is measured which is defined as the sensitivity A ($V \cdot m^2/mJ$) of the electrophotographic photoreceptor with the protective layer.

The sensitivity B ($V \cdot m^2/mJ$) of the electrophotographic photoreceptor (uncoated photoreceptor) before formation of the protective layer is measured in substantially the same manner as in measurement of the electrophotographic photoreceptor provided with the protective layer.

The reduction (ratio) in sensitivity by the presence of the protective layer is determined by the following equation 1.

$$\text{Reduction (\%) in sensitivity by presence of the protective layer} = ((\text{sensitivity } B - \text{sensitivity } A)/\text{sensitivity } B) \times 100 \quad \text{Equation 1}$$

Then, the wavelength of the exposure light is changed at 100-nm intervals from 400 nm to 800 nm and measured for reduction (%) in sensitivity in each wavelength.

From the reduction (%) in sensitivity in each wavelength obtained above, the reduction in sensitivity by the presence of the protective layer is evaluated according to the following evaluation criteria:

—Evaluation Criteria—

A: The reduction in sensitivity by the presence of the protective layer is less than 10% in the whole wavelength range, and the reduction in sensitivity by the presence of the protective layer is suppressed.

B: The reduction in sensitivity by the presence of the protective layer is from 10% to less than 30% in the whole wavelength range, and the reduction in sensitivity by the presence of the protective layer is within a practically acceptable range.

C: The reduction in sensitivity at a wavelength of 800 μm is in the range of from 30% to 35%, and the reduction in sensitivity by the presence of the protective layer is within a practically acceptable range.

D: The reduction in sensitivity at a wavelength of 800 nm exceeds 35%, and the reduction in sensitivity by the presence of the protective layer exceeds a practically acceptable range.

<Evaluation of Image Quality after Repeated Image Forming>

The electrophotographic photoreceptor provided with a protective layer is installed in a printer (trade name: DOCUCENTRE COLOR 500, manufactured by Fuji Xerox) and then subjected to a successive 20,000 sheet-printing test under a high temperature/high humidity environment (28° C., 80% RH) and then evaluation is performed as follows.

As a reference for image quality evaluation, the uncoated photoreceptor is also installed in DOCUCENTRE COLOR 500 and image formation is carried out similarly.

(White Lines)

White-line defects on images after 20,000 sheet-printing are evaluated. The evaluation criteria are as follows:

—Evaluation Criteria—

A: No white line-shaped image defects are observed.

B: Within a practically acceptable range although slight white-line image defects which appear to be attributable to scratches of the photoreceptor are observed.

C: A large number of white-line image defects which appear to be attributable to scratches of the photoreceptor are observed, and the white-line shaped defects exceed a practical acceptable range.

(Image Density)

After printing of 1000 sheets, 100 sheets are successively printed with a solid image with 100% area coverage, and the obtained image is evaluated for its image density under the following evaluation criteria.

—Evaluation Criteria—

A: No detection in density image is observed even after printing of 100 sheets or more.

B: Within a practically acceptable range, although a slight reduction in image density is observed from more than 90th sheet to 100th sheets.

C: Within a practically acceptable range, although a slight reduction in image density is observed from more than 70th to 90th sheets.

D: Practically unacceptable. Reduction in image density is easily recognized in the 70th or less sheets.

(Image Blurring)

In evaluation of image blurring, the photoreceptor after printing of 20,000 sheets is partially wiped with water for removing water-soluble discharged products.

Thereafter, a half-tone image (image density 30%) is printed, and the difference in density corresponding to the portion of the surface of the photoreceptor wiped with water and the portion thereof not wiped with water, in the half-tone image, is visually checked and evaluated under the following evaluation criteria:

—Evaluation Criteria—

A: No difference in density is observed.

B: Within a practically acceptable range, although a slight difference in density is observed.

C: Practically unacceptable. A difference in density is easily recognized.

(Scratches)

After the 20,000 sheet-printing test, the surface of the photoreceptor is visually observed and examined for its scratches on the surface.

Evaluation criteria are as follows:

—Evaluation Criteria—

A: No scratches on the surface are observed.

B: Within a practically acceptable range, although scratches on the surface are slightly observed.

C: Practically unacceptable. Scratches on the surface are easily recognized.

<Increase in Residual Potential (RP) in Repeated Use>

Before the 20,000 sheet-printing test in image evaluation described above, the electrophotographic photoreceptor provided with a protective layer is first measured for its residual potential at a wavelength of 780 nm.

Then, after the 20,000 sheet-printing test, the electrophotographic photoreceptor provided with a protective layer is measured for its residual potential at a wavelength of 780 nm.

The increase in residual potential in repeated use (increase (%)), on the basis of these results, is evaluated under the following criteria.

In Table 1 below, the residual potential is shown as "RP".

—Evaluation Criteria—

A: The increase in residual potential by the 20,000-sheet printing test is less than 10%, and the increase in the residual potential by repeated use is suppressed.

B: The increase in residual potential by the 20,000-sheet printing test is from 10% to less than 30%, and the increase in the residual potential by repeated use is within a practically acceptable range.

C: The increase in residual potential by the 20,000 sheet-printing test is 30% or more, and the increase in the residual potential by repeated use exceeds the practically acceptable range.

Example 2

An electrophotographic photoreceptor provided with a protective layer is prepared in substantially the same manner as in Example 1 except that, in the formation of the second layer, the flow rate of He-diluted 20% oxygen gas is changed to 10 sccm. Then, the sample is analyzed and evaluated in substantially the same manner as in Example 1.

The results of analysis and evaluation are shown in Table 1 below.

A diffraction image obtained by measurement of reflection high energy electron diffraction (RHEED) shows no dot or line, and the second layer is found to be amorphous.

The surface of the second layer is not scratched when rubbed with stainless steel.

The second layer formed on a quartz substrate is colored lightly yellow, and its transmittance at 780 nm is 85%.

Example 3

An electrophotographic photoreceptor provided with a protective layer is prepared in substantially the same manner as in Example 1 except that, in the formation of the second layer, an He-diluted 20% oxygen gas (20 sccm), an He gas (100 sccm), and an $H_2$ gas (500 seem) are changed to an He-diluted 20% oxygen gas (7 sccm) and an He gas (200 sccm), and the film-forming time is changed to 180 minutes. Then, the sample is analyzed and evaluated in substantially the same manner as in Example 1.

The results of analysis and evaluation are shown in Table 1 below.

A diffraction image obtained by measurement of reflection high energy electron diffraction (RHEED) shows no dot or line, and the second layer is found to be amorphous.

The surface of the second layer is not scratched when rubbed with stainless steel.

The second layer formed on a quartz substrate is colored lightly brown, and its transmittance at 780 nm is 70%.

Example 4

An electrophotographic photoreceptor provided with a protective layer is prepared in substantially the same manner as in Example 3 except that in the formation of the second layer, the film-forming time is changed to 60 minutes, Then the sample is analyzed and evaluated in substantially the same manner as in Example 3.

The results of analysis and evaluation are shown in Table 1 below.

A diffraction image obtained by measurement of reflection high energy electron diffraction (RHEED) shows no dot or line, and the second layer is found to be amorphous.

The surface of the second layer is not scratched when rubbed with stainless steel.

The second layer formed on a quartz substrate is colored lightly yellow, and its transmittance at 780 nm is 80%.

Example 5

An electrophotographic photoreceptor provided with a protective layer is prepared in substantially the same manner as in Example 1 except that, in the formation of the second layer, the flow rate of the He-diluted 20% oxygen gas is changed to 40 sccm, and the trimethyl gallium gas (3 sccm) is changed to a trimethyl gallium gas (2.4 sccm) and diethyl zinc (0.6 sccm). Then the sample is analyzed and evaluated in substantially the same manner as in Example 1.

The results of analysis and evaluation are shown in Table 1 below.

A diffraction image obtained by measurement of reflection high energy electron diffraction (RHEED) shows no dot or line, and the second layer is found to be amorphous.

The surface of the second layer is not scratched when rubbed with stainless steel.

The surface of the second layer formed on a quartz substrate is transparent, and its transmittance at 780 nm is 95%.

Example 6

An electrophotographic photoreceptor provided with a protective layer is prepared in substantially the same manner as in Example 5 except that, in the formation of the second layer, the trimethyl gallium gas (2.4 sccm) and diethyl zinc (0.6 sccm) are changed to a trimethyl gallium gas (2.1 sccm) and diethyl zinc (0.9 sccm). Then the sample is analyzed and evaluated in substantially the same manner as in Example 5.

The results of analysis and evaluation are shown in Table 1 below.

A diffraction image obtained by measurement of reflection high energy electron diffraction (RHEED) shows no dot or line, and the second layer is found to be amorphous.

The surface of the second layer is not scratched when rubbed with stainless steel.

The second layer formed on a quartz substrate is transparent, and its transmittance at 780 nm is 95%.

Example 7

An electrophotographic photoreceptor provided with a protective layer is prepared in substantially the same manner as in Example 5 except that an uncoated photoreceptor (2) prepared as described below is used in place of the uncoated photoreceptor (1). Then the sample is analyzed and evaluated in substantially the same manner as in Example 5.

The results of analysis and evaluation are shown in Table 1 below.

In the resulting electrophotographic photoreceptor provided with a protective layer the protective layer is not removed even with an adhesive tape, and is excellent in adhesiveness. This photoreceptor is more excellent in smoothness and slipping property than the uncoated photoreceptor (2) before formation of a protective layer.

—Preparation of Uncoated Photoreceptor (2)—

A 3-μm n-type $Si_3N_1$ charge injection blocking layer, a 20-μm i-type amorphous silicon photoconductive layer and a 0.5-μm p-type $Si_2C_1$ charge injection blocking surface layer are formed in this order by plasma CVD on an Al substrate, thereby preparing an uncoated photoreceptor (2) that is a negative charge-type amorphous silicon photoreceptor.

Example 8

An electrophotographic photoreceptor provided with a protective layer is prepared in substantially the same manner as in Example 1 except that an intermediate layer is formed after formation of the second layer and before formation of the first layer. Then the sample is analyzed and evaluated in substantially the same manner as in Example 1.

The results of analysis and evaluation are shown in Table 1 below.

The conditions for film-forming of the intermediate layer are substantially the same as those for forming the second layer except that the flow rate of the He-diluted 20% oxygen gas is changed to 8 sccm, and the film-forming time is changed such that the film thickness reaches 0.1 μm.

Example 9

An electrophotographic photoreceptor provided with a protective layer is prepared in substantially the same manner as in Example 1 except that before the formation of a second layer on the surface the uncoated photoreceptor (1), a third layer is formed on the uncoated photoreceptor (1). Then the sample is analyzed and evaluated in substantially the same manner as in Example 1.

The results of analysis and evaluation are shown in Table 1 below.

The conditions for film-forming of the third layer are substantially the same as those in the second layer except that the flow rate of the He-diluted 20% oxygen gas is changed to 8 sccm, and the film-forming time is changed such that the layer thickness becomes 0:05 μm.

Comparative Example 1

An electrophotographic photoreceptor provided with a protective layer is prepared in substantially the same manner as in Example 1 except that, in the formation of the second layer 2, the flow rate of the He-diluted 20% oxygen gas is changed to 1 sccm, and the film-forming time is changed to 240 minutes. Then the sample is analyzed and evaluated in substantially the same manner as in Example 1.

The results of analysis and evaluation are shown in Table 1 below.

The second layer (analysis sample film) formed on a quartz substrate is colored brown, and its transmittance at 780 nm is 40%.

Comparative Example 2

An electrophotographic photoreceptor provided with a protective layer is prepared in the same manner as in Example 1 except that in the formation of the first layer 1, the flow rate of the He-diluted 20% oxygen gas is changed to 2 sccm, and in the formation of the second layer, the flow rate of the He-diluted 20% oxygen gas is changed to 1 sccm, and the film-forming time is changed to 180 minutes. Then the sample is analyzed and evaluated in substantially the same manner as in Example 1.

The results of analysis and evaluation are shown in Table 1 below.

The second layer (analysis sample film) formed on a quartz substrate is colored brown, and its transmittance at 780 nm is 50%.

TABLE 1

| | | | Example 1 | Example 2 | Example 3 | Example 4 | Example 5 | Example 6 |
|---|---|---|---|---|---|---|---|---|
| Protective Layer | First layer | Elemental species contained | Ga, O, H | Ga, O, H | Ga, O, H | Ga, O, H | Ga, O, H | Ga, O, H |
| | | Ratio of number of atoms (O/Ga) | 1.20 | 1.20 | 1.20 | 1.20 | 1.20 | 1.20 |
| | | Hydrogen content (% by atom) | 18 | 18 | 18 | 18 | 18 | 18 |
| | | Layer thickness (μm) | 0.3 | 0.3 | 0.3 | 0.3 | 0.3 | 0.3 |
| | Intermediate | Elemental species contained | — | — | — | — | — | — |
| | | Ratio of number of atoms (O/Ga) | — | — | — | — | — | — |

TABLE 1-continued

| | | | | | | | | |
|---|---|---|---|---|---|---|---|---|
| | layer | Hydrogen content (% by atom) | — | — | — | — | — | — |
| | | Layer thickness (μm) | — | — | — | — | — | — |
| | Second layer | Elemental species contained | Ga, O, H | Ga, O, H | Ga, O, H | Ga, O, H | Ga, O, H, Zn | Ga, O, H, Zn |
| | | Ratio of number of atoms (O/Ga) | 1.50 | 1.30 | 1.35 | 1.35 | 1.60 | 1.65 |
| | | Ratio of number of atoms (Zn/Ga) | — | — | — | — | 0.25 | 0.34 |
| | | Hydrogen content (% by atom) | 16 | 17 | 20 | 20 | 19 | 18 |
| | | Layer thickness (μm) | 3.5 | 4.0 | 3.5 | 1.2 | 4.0 | 4.0 |
| | Third layer | Elemental species contained | — | — | — | — | — | — |
| | | Ratio of number of atoms (O/Ga) | — | — | — | — | — | — |
| | | Hydrogen content (% by atom) | — | — | — | — | — | — |
| | | Layer thickness (μm) | — | — | — | — | — | — |
| Uncoated photoreceptor | | | (1) | (1) | (1) | (1) | (1) | (1) |
| Evaluation Results | Residual potential (V) | | −70 | −80 | −70 | −50 | −30 | −25 |
| | Reduction (%) in sensitivity at 780 nm | | 10 | 15 | 30 | 20 | 5 | 5 |
| | Reduction in sensitivity by presence of protective layer | | B | B | C | B | A | A |
| | Image qualities | White lines (durability) | A | A | A | B | A | A |
| | | Image density | B | B | C | B | A | A |
| | | Image blurring | A | A | A | A | A | A |
| | Scratches (durability) | | A | A | A | B | A | A |
| | Increase in RP in repeated use | | B | B | B | B | A | A |

| | | | Example 7 | Example 8 | Example 9 | Comparative Example 1 | Comparative Example 2 |
|---|---|---|---|---|---|---|---|
| Protective Layer | First layer | Elemental species contained | Ga, O, H | Ga, O, H | Ga, O, H | Ga, O, H | Ga, O, H |
| | | Ratio of number of atoms O/Ga | 1.20 | 1.20 | 1.20 | 1.20 | 1.25 |
| | | Hydrogen content (% by atom) | 18 | 18 | 18 | 18 | 18 |
| | | Layer thickness (μm) | 0.3 | 0.3 | 0.3 | 0.3 | 0.2 |
| | Intermediate layer | Elemental species contained | — | Ga, O, H | — | — | — |
| | | Ratio of number of atoms O/Ga | — | 1.30 | — | — | — |
| | | Hydrogen content (% by atom) | — | 17 | — | — | — |
| | | Layer thickness (μm) | — | 0.1 | — | — | — |
| | Second layer | Elemental species contained | Ga, O, H, Zn | Ga, O, H | Ga, O, H | Ga, O, H | Ga, O, H |
| | | Ratio of number of atoms O/Ga | 1.60 | 1.50 | 1.50 | 1.20 | 1.20 |
| | | Ratio of number of atoms Zn/Ga | 0.25 | — | — | — | — |
| | | Hydrogen content (% by atom) | 19 | 16 | 16 | 20 | 20 |
| | | Layer thickness (μm) | 4.0 | 3.5 | 3.5 | 3.0 | 2.0 |
| | Third layer | Elemental species contained | — | — | Ga, O, H | — | — |
| | | Ratio of number of atoms O/Ga | — | — | 1.30 | — | — |
| | | Hydrogen content (% by atom) | — | — | 17 | — | — |
| | | Layer thickness (μm) | — | — | 0.05 | — | — |
| Uncoated photoreceptor | | | (2) | (1) | (1) | (1) | (1) |
| Evaluation Results | Residual potential (V) | | −30 | −50 | −50 | −30 | −30 |
| | Reduction (%) in sensitivity at 780 nm | | 5 | 15 | 15 | 60 | 50 |
| | Reduction in sensitivity by presence of protective layer | | A | B | B | D | D |
| | Image qualities | White lines (durability) | A | A | A | A | A |
| | | Image density | A | B | B | D | D |
| | | Image blurring | A | A | A | A | A |
| | Scratches (durability) | | A | A | A | A | B |
| | Increase in RP in repeated use | | A | A | A | A | A |

As shown in Table 1, in Examples 1 to 9 wherein the protective layer includes a first region (a first layer) including the outermost surface and a second region (a second layer) having a ratio of the number of atoms oxygen/gallium larger than that in the first region, the reduction in sensitivity by the presence the protective layer is suppressed, and the reduction in image density, associated with the reduction in sensitivity, is also suppressed.

Further, in Examples 1 to 9, the residual potential is also reduced.

On the other hand, in Comparative Examples 1 and 2, the sensitivity is significantly lowered and the image density is reduced.

Moreover, in Comparative Examples 1 and 2, the growth rate (film-forming rate) is low thus indicating low productivity.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. An electrophotographic photoreceptor comprising, in this order:

a substrate;

a photosensitive layer; and a protective layer including oxygen and gallium, the protective layer including a first region and a second region that is present closer to the substrate than the first region and has a ratio of the number of atoms of oxygen to the number of atoms of gallium (oxygen/gallium) larger than that in the first region, the first region and the second region each comprising oxygen, the second region having a ratio of the number of atoms of oxygen to the number of atoms of gallium (oxygen/gallium) of from about 1.30 to 1.65, and the first region having a ratio of the number of atoms of oxygen to the number of atoms of gallium (oxygen/gallium) of from 1.00 to 1.30.

2. The electrophotographic photoreceptor of claim 1, wherein the second region has a ratio of the number of atoms of oxygen to the number of atoms of gallium (oxygen/gallium) of from about 1.30 to about 1.50.

3. The electrophotographic photoreceptor of claim 1, further comprising zinc in the second region.

4. The electrophotographic photoreceptor of claim 3, wherein the content of zinc in the second region is from about 0.4% by atom to about 25% by atom.

5. The electrophotographic photoreceptor of claim 3, wherein the content of zinc in the second region is from about 0.5% by atom to about 20% by atom.

6. The electrophotographic photoreceptor of claim 3, wherein the second region has a ratio of the number of atoms of oxygen to the sum of the number of atoms of gallium and zinc (oxygen/(gallium+zinc)) of from about 1 to about 1.40.

7. The electrophotographic photoreceptor of claim 1, wherein the protective layer has a thickness of about 1.0 μm or more.

8. The electrophotographic photoreceptor of claim 1, wherein the protective layer further includes a third region that is present closer to the substrate than the second region, contacts with the photosensitive layer, and has a ratio of the number of atoms of oxygen to the number of atoms of gallium (oxygen/gallium) smaller than that in the second region.

9. The electrophotographic photoreceptor of claim 1, wherein the protective layer includes a first layer that is the first region and a second layer that is the second region, and further includes, between the first layer and the second layer, an intermediate layer that has a ratio of the number of atoms of oxygen to the number of atoms of gallium (oxygen/gallium) equal to or larger than the ratio of the number of atoms of oxygen to the number of atoms of gallium (oxygen/gallium) of the first layer and equal to or smaller than the ratio of the number of atoms of oxygen to the number of atoms of gallium (oxygen/gallium) of the second layer.

10. The electrophotographic photoreceptor of claim 1, wherein:

the second region has a ratio of the number of atoms of oxygen to the number of atoms of gallium (oxygen/gallium) of from about 1.30 to about 1.50; and the first region has a ratio of the number of atoms of oxygen to the number of atoms of gallium (oxygen/gallium) of from 1.00 to 1.20.

11. The electrophotographic photoreceptor of claim 1 wherein the second region is directly adjacent to the photosensitive layer.

12. A process cartridge comprising;

the electrophotographic photoreceptor of claim 1; and at least one selected from the group consisting of a charging unit, a developing unit and a cleaning unit.

13. An electrophotographic photoreceptor comprising, in this order:

a substrate;

a photosensitive layer; and a protective layer including oxygen and gallium, the protective layer including a first region and a second region that is present closer to the substrate than the first region and has a ratio of the number of atoms of oxygen to the number of atoms of gallium (oxygen/gallium) larger than that in the first region, wherein the protective layer comprises zinc in the second region, the content of zinc in the second region being from about 10 % by atom to about 20 % by atom.

14. An image forming apparatus comprising:

an electrophotographic photoreceptor comprising, in this order a substrate, a photosensitive layer, and a protective layer including oxygen and gallium, the protective layer including a first region and a second region that is present closer to the substrate than the first region and has a ratio of the number of atoms of oxygen to the number of atoms of gallium (oxygen/gallium) larger than that in the first region, the first region and the second region each comprising oxygen, the second region having a ratio of the number of atoms of oxygen to the number of atoms of gallium (oxygen/gallium) of from about 1.30 to 1.65, and the first region having a ratio of the number of atoms of oxygen to the number of atoms of gallium (oxygen/gallium) of from 1.00 to 1.30;

a charging unit that charges the electrophotographic photoreceptor;

a latent image forming unit that forms a latent image on the surface of the charged electrophotographic photoreceptor;

a developing unit that develops the latent image formed on the surface of the electrophotographic photoreceptor with a toner to form a toner image; and a transfer unit that transfers the toner image formed on the surface of the electrophotographic photoreceptor onto a recording medium.

15. The image forming apparatus of claim 14, wherein the second region has a ratio of the number of atoms of oxygen to the number of atoms of gallium (oxygen/gallium) of from about 1.30 to about 1.50.

16. The image forming apparatus of claim 14, further comprising zinc in the second region.

17. The image forming apparatus of claim 16, wherein the second region has a ratio of the number of atoms of oxygen to the sum of the number of atoms of gallium and zinc (oxygen/(gallium+zinc)) of from about 1 to about 1.40.

18. The image forming apparatus of claim 14, wherein the protective layer has a thickness of about 1.0 μm or more.

19. The image forming apparatus of claim 14, wherein the protective layer further includes a third region that is present closer to the substrate than the second region, contacts with the photosensitive layer, and has a ratio of the number of atoms of oxygen to the number of atoms of gallium (oxygen/gallium) smaller than that in the second region.

20. The image forming apparatus of claim 14, wherein the protective layer includes a first layer that is the first region and a second layer that is the second region, and further includes, between the first layer and the second layer, an intermediate layer that has a ratio of the number of atoms of oxygen to the number of atoms of gallium (oxygen/gallium) equal to or larger than the ratio of the number of atoms of oxygen to the number of atoms of gallium (oxygen/gallium) of the first layer and equal to or smaller than the ratio of the number of atoms of oxygen to the number of atoms of gallium (oxygen/gallium) of the second layer.

* * * * *